US005627015A

United States Patent [19]

Okada et al.

[11] Patent Number: 5,627,015

[45] Date of Patent: May 6, 1997

[54] METHOD FOR PROCESSING SILVER HALIDE COLOR PHOTOGRAPHIC MATERIAL

[75] Inventors: Hisashi Okada; Yoshihiro Fujita, both of Kanagawa, Japan

[73] Assignee: Fuji Photo Film Co., Ltd., Kanagawa, Japan

[21] Appl. No.: 350,969

[22] Filed: Dec. 7, 1994

[30] Foreign Application Priority Data

Dec. 7, 1993 [JP] Japan ..... 5-306813

[51] Int. Cl.[6] ..... G03C 7/42

[52] U.S. Cl. ..... 430/393; 430/430; 430/460; 430/461

[58] Field of Search ..... 430/393, 430, 430/460, 461

[56] References Cited

U.S. PATENT DOCUMENTS

| | | | |
|---|---|---|---|
| 4,524,129 | 6/1985 | Kishimoto et al. | 430/393 |
| 5,238,791 | 8/1993 | Tappe et al. | 430/393 |
| 5,338,649 | 8/1994 | Inaba et al. | 430/430 |

FOREIGN PATENT DOCUMENTS

| | | |
|---|---|---|
| 0329088 | 8/1989 | European Pat. Off. . |
| 0468325A1 | 1/1992 | European Pat. Off. . |
| 0553569 | 12/1992 | European Pat. Off. . |
| 0556782 | 8/1993 | European Pat. Off. . |
| 0588289 | 3/1994 | European Pat. Off. . |
| 3939756A1 | 6/1991 | Germany . |
| 026542 | 3/1975 | Japan . |
| 51-29015 | 8/1976 | Japan . |
| 462545 | 2/1992 | Japan . |
| 5265159 | 10/1993 | Japan . |

*Primary Examiner*—Hoa Van Le

*Attorney, Agent, or Firm*—Sughrue, Mion, Zinn, Macpeak & Seas

[57] ABSTRACT

To achieve superior desilvering property and reduced stains even with the use of a biodegradable bleaching agent in a dilute concentration, the processing is conducted with a processing solution comprising a ferric complex salt of the compound of formula (I) or (II) and, for example, a 2-carboxypyridyl and having bleaching ability. (In the formulae, $R_1$ to $R_5$ represent, for example, a hydrogen atom or a carboxyl group, $L_1$ to $L_5$ represent, for example, an alkylene group, $G_1$ and $G_2$ represent, for example, a carboxyl group or an aryl group and X represents, for example, a hydrogen atom).

(I)

(II)

9 Claims, No Drawings

METHOD FOR PROCESSING SILVER HALIDE COLOR PHOTOGRAPHIC MATERIAL

FIELD OF THE INVENTION

The present invention relates to a method for processing a silver halide color photographic material, which is superior in view of environmental conservation. In particular, it relates to a method for processing a silver halide color photographic material, which achieves excellent biodegradation, is susceptible little to a photographically adverse effect such as stain, and exhibits superior bleaching ability.

BACKGROUND OF THE INVENTION

In general, a silver halide black-and-white photographic material is processed through processing steps such as black-and-white development, fixing and water washing after exposure, and a silver halide color photographic material (hereinafter referred to as color photographic material) is processed through processing steps such as color development, desilvering, water washing and stabilization after exposure. A silver halide color reversal photographic material is processed through processing steps such as black-and-white development after exposure and color development, desilverization, water washing and stabilization after reversal processing.

In the case of color development, exposed silver halide grains are reduced to silver by a color developing agent and the oxidation product of the color developing agent reacts with a coupler to form an image dye during the color development step.

In the subsequent desilverization step, the developed silver generated during development is oxidized (bleached) to silver salt by the bleaching agent (oxidizing agent) and then removed (fixed) from the light-sensitive layer together with unexposed silver halide by the fixing agent capable of forming a soluble silver. The bleaching and fixing may be conducted separately as the bleaching step and the fixing step or may be conducted simultaneously as the bleach-fixing step. The details on these processing steps as well as on the processing compositions therefor are described in James, *The Theory of Photographic Process,* 4th ed. (1977), *Research Disclosure* No. 17643, Items 28 and 29, ibid., No. 18716, from left column to right column at 651, ibid., No. 307105, Items 880 and 881.

In addition to the above-described fundamental processing steps, various auxiliary steps may be provided so as to maintain photographic and physical qualities of the dye image or to ensure the safety in processing. Examples thereof include water washing step, stabilization step, film hardening step and stopping step.

Further, the developed silver halide black-and-white photographic material is processed with a reducer containing an oxidizing agent so as to control the gradation and the like.

The oxidizing agent added to the processing solution for use in the above-described bleaching or reducing is generally ethylenediaminetetraacetato ferric complex salt or 1,3-diaminopropanetetraacetato ferric complex salt, which is hardly biodegraded. Recently, from the standpoint of environmental conservation, the photographic processing solution exhausted from these photographic processings has been demanded to cause no nuisance and accordingly, an alternative to the above-described bleaching agent insusceptible of biodegradation has been investigated.

The bleaching agent having biodegradability includes a ferric complex salt of N-(2-carboxymethoxyphenyl) iminodiacetic acid disclosed in West German Patent (OLS) No. 3,912,551, ferric complex salts of β-alaninediacetic acid and of glycine dipropionic acid disclosed in EP-A-430000, and a ferric complex salt of ethylenediamine-N,N'-disuccinic acid disclosed in JP-A-5-72695 (the term "JP-A" as used herein means an "unexamined published Japanese patent application"). However, the processing solution having bleaching ability and comprising such a bleaching agent cannot be said satisfactory in its desilvering property and it has been found that, when a continuous processing is conducted using such a solution, there arise problems that the desilvering property is reduced as compared with the initial stage of the continuous processing, that the bleaching fog increases and that the prevention of stains due to aging is insufficient.

It has recently become popular to conduct the color development in a miniaturized automatic developer called mini-lab so as to provide rapid processing service to users, in which the stability in performance is indispensable for a continuous processing, to say nothing of rapid bleaching.

Further, the metal chelating compound used as a bleaching agent has been demanded to have a reduced concentration in view also of environmental conservation. However, the above-described bleaching agents in a dilute concentration have failed to provide sufficient desilverization.

SUMMARY OF THE INVENTION

Accordingly, a first object of the present invention is to provide a processing method of a silver halide color photographic material, which is afforded by good handle-ability and free of environmental issue such as waste solution.

A second object of the present invention is provide a processing method of a silver halide color photographic material using a processing solution having bleaching ability and capable of exhibiting excellent desilverization even in a dilute concentration.

A third object of the present invention is to provide a processing method of a silver halide color photographic material, which is susceptible little to stains.

A fourth object of the present invention is to provide a processing method of a silver halide color photographic material, which can stably maintain the above-described performance in a continuous processing.

A fifth object of the present invention is to provide a processing method of a silver halide color photographic material using a processing solution having bleaching ability and being advantageous in view of the biodegradability and environmental conversation.

The above-described objects are achieved by the following methods.

(1) A method for processing a silver halide color photographic material comprising processing an imagewise exposed silver halide color photographic material with a processing solution having bleaching ability after color development, wherein said processing solution having bleaching ability comprises at least one ferric complex salt of the compound represented by formula (I) or (II) and at least one compound represented by formula (III):

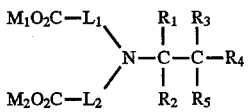

(I)

(wherein $R_1$, $R_2$, $R_3$, $R_4$ and $R_5$ each represents a hydrogen atom, an aliphatic group, an aryl group, a heterocyclic group, a carboxyl group, a phosphono group, a hydroxy group or a sulfo group, with the proviso that at least one of $R_1$, $R_2$, $R_3$, $R_4$ and $R_5$ represents a carboxyl group, a phosphono group, a sulfo group, or an aliphatic, aryl or heterocyclic group substituted by a carboxyl group, $L_1$ and $L_2$ each represents a divalent aliphatic group, a divalent aromatic group or a divalent linking group composed of a combination thereof, and $M_1$ and $M_2$ each represents a hydrogen atom or a cation),

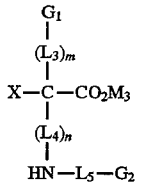

(II)

(wherein $G_1$ and $G_2$ each represents a carboxyl group, a phosphono group, a hydroxyl group, a sulfo group, a mercapto group, an aryl group, a heterocyclic group, an alkylthio group, an amidino group, a guanidino group or a carbamoyl group, $L_3$, $L_4$ and $L_5$ each represents a divalent aliphatic group, a divalent aromatic group or a divalent linking group composed of a combination thereof, m and n each represents 0 or 1, X represents a hydrogen atom, an aliphatic group, an aryl group or a heterocyclic group and $M_3$ represents a hydrogen atom or a cation),

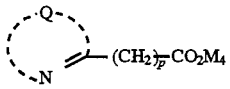

(III)

(wherein Q represents a nonmetallic atomic group necessary for forming a nitrogen-containing heterocyclic ring, p represents 0 or 1 and $M_4$ represents a hydrogen atom or a cation).

(2) A method for processing a silver halide color photographic further comprising processing with a processing solution having fixing ability which contains an aminopolycarboxylic acid and/or an organic phosphonic acid after processing with the above-described processing solution having bleaching ability.

DETAILED DESCRIPTION OF THE INVENTION

First, the compound represented by general formula (I) will be described below in detail.

The aliphatic group for $R_1$, $R_2$, $R_3$, $R_4$ or $R_5$ is an alkyl group (preferably having from 1 to 6 carbon atoms), an alkenyl group (having from 2 to 6 carbon atoms) or an alkynyl group (having from 2 to 6 carbon atoms), each of which may be linear, branched or cyclic, and more preferably an alkyl group. Examples of the aliphatic group include a methyl group, an ethyl group, a cyclohexyl group, a benzyl group and an allyl group. The aliphatic group may have a substituent and examples of the substituent include an alkyl group (having from 1 to 12, preferably from 1 to 6, more preferably from 1 to 3 carbon atoms, e.g., methyl, ethyl), an aralkyl group (having from 7 to 13, preferably from 7 to 11, more preferably from 7 to 9 carbon atoms, e.g., phenylmethyl), an alkenyl group (having from 2 to 12, preferably from 2 to 6, more preferably from 2 to 4 carbon atoms, e.g., allyl), an alkynyl group (having from 2 to 12, preferably from 2 to 6, more preferably from 2 to 4 carbon atoms), an alkoxy group (having from 1 to 8, preferably from 1 to 6, more preferably from 1 to 4 carbon atoms, e.g., methoxy, ethoxy), an aryl group (having from 6 to 12, preferably from 6 to 10, more preferably from 6 to 8 carbon atoms, e.g., phenyl, p-methylphenyl), an acylamino group (having from 2 to 10, preferably from 2 to 6, more preferably from 2 to 4 carbon atoms, e.g. , acetylamino), a sulfonylamino group (having from 1 to 10, preferably from 1 to 6, more preferably from 1 to 4 carbon atoms, e.g., methanesulfonylamino), a ureido group (having from 1 to 10, preferably from 1 to 6, more preferably from 1 to 4 carbon atoms), an alkoxycarbonylamino group (having from 2 to 12, preferably from 2 to 10, more preferably from 2 to 8 carbon atoms, e.g., methoxycarbonylamino), an aryloxycarbonylamino group (having from 7 to 13, preferably from 7 to 11, more preferably from 7 to 9 carbon atoms, e.g., phenoxycarbonylamino), an aryloxy group (having from 6 to 12, preferably from 6 to 10, more preferably from 6 to 8 carbon atoms, e.g., phenyloxy), a sulfamoyl group (having from 0 to 10, preferably from 0 to 6, more preferably from 0 to 4 carbon atoms, e.g., methylsulfamoyl), a carbamoyl group (having from 1 to 10, preferably from 1 to 6, more preferably from 1 to 4 carbon atoms, e.g., carbamoyl, methylcarbamoyl), an alkylthio group (having from 1 to 8, preferably from 1 to 6, more preferably from 1 to 4 carbon atoms, e.g., methylthio, carboxylmethylthio), an arylthio group (having from 6 to 12, preferably from 6 to 10, more preferably from 6 to 8 carbon atoms, e.g., phenylthio), a sulfonyl group (having from 1 to 8, preferably from 1 to 6, more preferably from 1 to 4 carbon atoms, e.g., methanesulfonyl), a sulfinyl group (having from 1 to 8, preferably from 1 to 6, more preferably from 1 to 4 carbon atoms, e.g., methanesulfinyl), a hydroxyl group, a halogen atom (e.g., chlorine, bromine, fluorine), a cyano group, a sulfo group, a carboxyl group, a phosphono group, an aryloxycarbonyl group (having from 7 to 13, preferably from 7 to 11, more preferably from 7 to 9 carbon atoms, e.g., phenyloxycarbonyl), an acyl group (having from 2 to 12, preferably from 2 to 10, more preferably from 2 to 8 carbon atoms, e.g., acetyl, benzoyl), an alkoxycarbonyl group (having from 2 to 12, preferably from 2 to 10, more preferably from 2 to 8 carbon atoms, e.g., methoxycarbonyl), an acyloxy group (having from 2 to 12, preferably from 2 to 10, more preferably from 2 to 8 carbon atoms, e.g., acetoxy), a nitro group, a hydroxamic acid group (having from 1 to 8, preferably from 1 to 6, more preferably from 1 to 4 carbon atoms) and a heterocyclic group (e.g., imidazolyl, pyridyl).

The aryl group for $R_1$, $R_2$, $R_3$, $R_4$ or $R_5$ may be monocyclic or bicyclic and preferably has from 6 to 20 carbon atoms. Examples thereof include a phenyl group and a naphthyl group, The aryl group may have a substituent and examples of the substituent include those described for the substituent which the aliphatic group for $R_1$, $R_2$, $R_3$, $R_4$ or $R_5$ may have.

The heterocyclic group for $R_1$, $R_2$, $R_3$, $R_4$ or $R_5$ is a saturated or unsaturated, 3- to 10-membered heterocyclic group containing at least one of nitrogen atom, oxygen atom and sulfur atom, which may be monocyclic or may form a condensed ring with another aromatic or heterocyclic ring. The heterocyclic ring is preferably a 5- or 6-membered unsaturated heterocyclic ring and more preferably a 5- or 6-membered aromatic heterocyclic ring with the hetero atom being nitrogen atom. The heterocyclic ring is preferably pyridine, pyrazine, pyrimidine, pyridazine, thiophene, pyrrole, imidazole, pyrazole, thiazole, oxazole or indole, and more preferably pyridine, imidazole or indole.

$R_1$, $R_2$, $R_3$, $R_4$ and $R_5$ each is preferably a hydrogen atom, a carboxyl group, a hydroxyl group, a carboxymethyl group or a hydroxymethyl group. $R_4$ is more preferably a carboxyl group.

Examples of the divalent aliphatic group for $L_1$ or $L_2$ include an alkylene group (preferably having from 1 to 6 carbon atoms), an alkenylene group (preferably having from 2 to 6 carbon atoms) and an alkynylene group (preferably having from 2 to 6 carbon atoms), each of which may be linear, branched or cyclic. The divalent aliphatic group for $L_1$ or $L_2$ may have a substituent and examples of the substituent include those described for the substituent which the aliphatic group for $R_1$, $R_2$, $R_3$, $R_4$ or $R_5$ may have. Specific examples of the divalent aliphatic group for $L_1$ or $L_2$ include a methylene group, an ethylene group, a 1-carboxymethylene group, 1-carboxyethylene group, 2-hydroxyethylene group, 2-hydroxypropylene group, 1-phosphonomethylene group, 1-phenylmethylene group and 1-carboxybutylene group.

The divalent aromatic group for $L_1$ or $L_2$ include a divalent aromatic hydrocarbon group (e.g., arylene) and a divalent aromatic heterocyclic group.

The divalent aromatic hydrocarbon group (e.g., arylene) may be monocyclic or bicyclic and preferably has from 6 to 20 carbon atoms. Examples of the divalent aromatic hydrocarbon group include a phenylene group and a naphthylene group.

The divalent aromatic heterocyclic group may be a 3- to 10-membered ring containing at least one of nitrogen atom, oxygen atom and sulfur atom, and it may be monocyclic or may form a condensed ring together with another aromatic or heterocyclic ring. It is preferably a 5- or 6-membered aromatic heterocyclic ring with the hetero atom being nitrogen atom.

Examples of the divalent aromatic heterocyclic ring include the following.

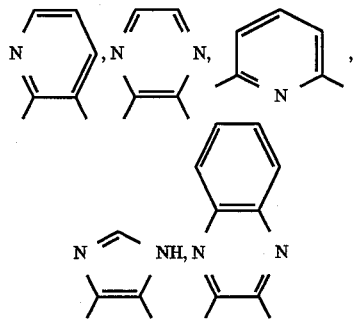

The divalent aromatic group is preferably an arylene group (preferably having from 6 to 20 carbon atoms), more preferably a phenylene group or a naphthylene group, and most preferably a phenylene group.

The divalent aromatic group for $L_1$ or $L_2$ may have a substituent and examples of the substituent include those described for the substituent which the aliphatic group for $R_1$, $R_2$, $R_3$, $R_4$ or $R_5$ may have.

$L_1$ or $L_2$ may be a combination of a divalent aliphatic group and a divalent aromatic group and examples thereof include:

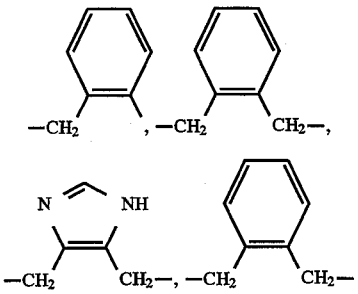

$L_1$ or $L_2$ is preferably an alkylene or o-phenylene group having from 1 to 3 carbon atoms, each of which may be substituted, more preferably a methylene group or an ethylene group, each of which may be substituted, and particularly preferably a methylene group which may be substituted.

The cation for $M_1$ or $M_2$ is an organic or inorganic cation and examples thereof include ammonium (e.g., ammonium, tetraethylammonium), pyridinium and an alkali metal (e.g., lithium, sodium, potassium).

The compound represented by formula (I) is preferably a compound represented by formula (IV)

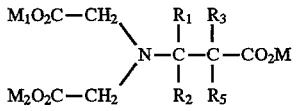

(IV)

wherein $M_1$ and $M_2$ each has the same meaning as those in formula (I), $R_1$, $R_2$, $R_3$ and $R_5$ each represents a hydrogen atom, an aliphatic group, an aryl group, a heterocyclic group, a carboxyl group, a phosphono group, a hydroxyl group or a sulfo group, and M has the same meaning as $M_1$ in formula (I).

Specific examples of the compound represented by general formula (I) will be described below but the present invention is by no means limited to these compounds.

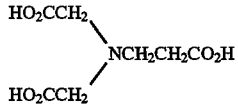

I-1

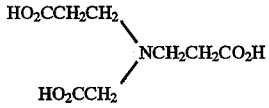

I-2

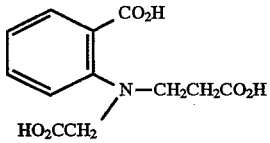

I-3

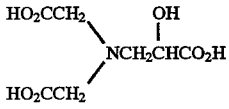

I-4

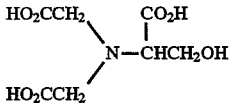

I-5

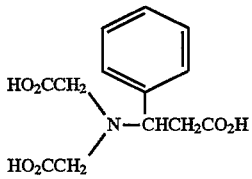

I-6

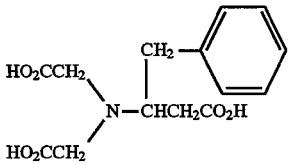

I-7

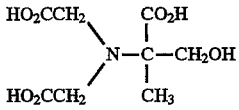

I-8

-continued

I-9

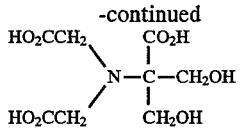

I-10

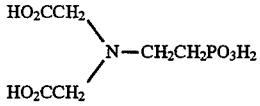

I-11

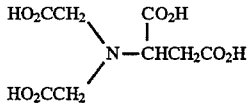

I-12

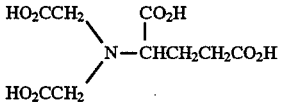

I-13

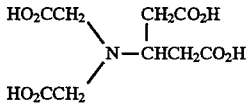

I-14

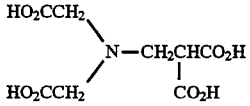

I-15

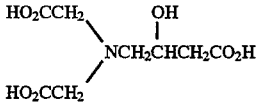

I-16

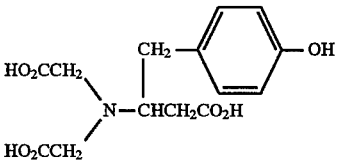

I-17

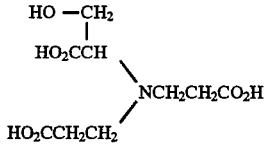

I-18

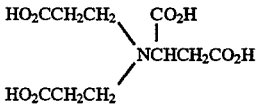

Of them, Compounds I-1, I-6, I-7 and I-11 are preferred.

The above-described compounds may be used in the form of an ammonium salt or an alkali metal salt.

The compound represented by general formula (I) can be synthesized according to the methods described in JP-A-63-267750, JP-A-63-267751, JP-A-2-115172 and JP-A-2-295954.

The compound represented by formula (II) will be described below in detail.

The aryl group (an aromatic hydrocarbon group) for $G_1$ or $G_2$ may be monocyclic or bicyclic and preferably has from 6 to 20 carbon atoms. Examples thereof include a phenyl group and a naphthyl group. The aryl group may have a substituent and examples of the substituent include those described for the substituent which the aliphatic group for $R_1$, $R_2$, $R_3$, $R_4$ or $R_5$ of formula (I) may have.

The heterocyclic group for $G_1$ or $G_2$ is a saturated or unsaturated, 3- to 10-membered heterocyclic group containing at least one of nitrogen atom, oxygen atom and sulfur atom and it may be a monocyclic or may form a condensed ring together with another aromatic or heterocyclic ring. The heterocyclic ring is preferably a 5- or 6-membered unsaturated heterocyclic ring and more preferably a 5- or 6-membered aromatic heterocyclic group with the hetero atom being nitrogen atom. The heterocyclic ring is preferably pyridine, pyrazine, pyrimidine, pyridazine, thiophene, pyrrole, imidazole, pyrazole, thiazole, oxazole, triazole or indole, and more preferably pyridine, imidazole or indole.

The alkylthio group for $G_1$ or $G_2$ is represented by —$SR_s$ (wherein $R_s$ represents an alkyl group). The alkyl group for $R_s$ is a linear, branched or cyclic alkyl group preferably having from 1 to 6 carbon atoms and particularly preferably a linear alkyl group having from 1 to 4 carbon atoms. The alkyl group for $R_s$ may have a substituent and examples of the substituent include those described for the substituent which the aliphatic group for $R_1$, $R_2$, $R_3$, $R_4$ or $R_5$ of general formula (I) may have. Specific examples of the alkylthio group for $G_1$ or $G_2$ include a methylthio group, an ethylthio group, a hydroxyethylthio group and a carboxylmethylthio group, with the methylthio group and the ethylthio group being preferred.

The carbamoyl group for $G_1$ or $G_2$ may be substituted and may be represented by —$CONRa_1(Ra_2)$, wherein $Ra_1$ and $Ra_2$ each represents a hydrogen atom, an alkyl group or an aryl group. The alkyl group for $Ra_1$ or $Ra_2$ is a linear, branched or cyclic alkyl group, which may be substituted and preferably has from 1 to 10 carbon atoms. The aryl group for $Ra_1$ or $Ra_2$ may be substituted and preferably has from 6 to 10 carbon atoms and it is more preferably a phenyl group. $Ra_1$ and $Ra_2$ may combine to form a ring. $Ra_1$ and $Ra_2$ each is particularly preferably a hydrogen atom, an alkyl group having from 1 to 4 carbon atoms, which may be substituted, or a phenyl group which may be substituted. Examples of the substituent for the alkyl group or the aryl group for $Ra_1$ or $Ra_2$ include those described for the substituent which the aliphatic group for $R_1$, $R_2$, $R_3$, $R_4$ or $R_5$ may have. Specific examples of the carbamoyl group for $G_1$ or $G_2$ include a carbamoyl group, an N-methylcarbamoyl group, an N-phenylcarbamoyl group and a morpholinocarbamoyl group.

$G_1$ is preferably a carboxyl group, a hydroxyl group, an aryl group or a heterocyclic group and most preferably a carboxyl group. $G_2$ is preferably a carboxyl group, a hydroxyl group, a sulfo group, a phosphono group, an aryl group or a heterocyclic group, more preferably a carboxyl group, an aryl group or a heterocyclic group, and most preferably a carboxyl group.

The divalent aliphatic group, the divalent aromatic group and the divalent linking group composed of a combination thereof for $L_3$, $L_4$ or $L_5$ have the same meaning as those for $L_1$ or $L_2$ in general formula (I).

m and n each is 0 or 1. m is preferably 1 and n is preferably 0.

The aliphatic group for X is a linear, branched or cyclic alkyl group (preferably having from 1 to 6 carbon atoms), an alkenyl group (preferably having from 2 to 6 carbon atoms) or an alkynyl group (preferably having from 2 to 6 carbon atoms), more preferably an alkyl group. Examples of the aliphatic group include a methyl groups, an ethyl group, a cyclohexyl group, a benzyl group and an allyl group.

The aryl group for X may be monocyclic or bicyclic and preferably has from 6 to 20 carbon atoms. Examples thereof include a phenyl group and a naphthyl group.

The heterocyclic group for X is a saturated or unsaturated 3- to 10-membered heterocyclic group containing at least one of nitrogen atom, oxygen atom or sulfur atom, and it may be monocyclic or may form a condensed ring together with another aromatic or heterocyclic ring. The heterocyclic ring is preferably a 5- or 6-membered unsaturated heterocyclic ring and more preferably a 5- or 6-membered aromatic heterocyclic group with the hetero atom being nitrogen atom. The heterocyclic ring is preferably pyridine, pyrazine, pyrimidine, pyridazine, thiophene, pyrrole, imidazole, pyrazole, thiazole or indole and more preferably pyridine or imidazole.

The aliphatic group, the aryl group or the heterocyclic group for X may have a substituent and examples of the substituent include those described for the substituent which the aliphatic group for $R_1$, $R_2$, $R_3$, $R_4$ or $R_5$ in formula (I) may have.

X is preferably a hydrogen atom or an alkyl group having from 1 to 3 carbon atoms, more preferably a hydrogen atom.

$M_3$ has the same meaning as $M_1$ or $M_2$ in formula (I).

The compound represented by formula (II) is preferably a compound represented by formula (V):

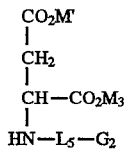

(V)

wherein $G_2$, $L_5$ and $M_3$ each has the same meaning as those in formula (II). M' represents a hydrogen atom or a cation. M' has the same meaning as $M_1$ or $M_2$ in formula (I).

Specific examples of the compound represented by formula (II) will be described below, but the present invention is by no means limited to these compounds.

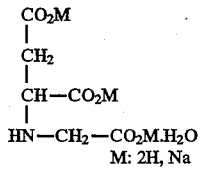

II-1

M: 2H, Na

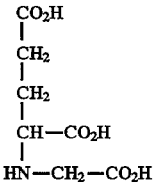

II-2

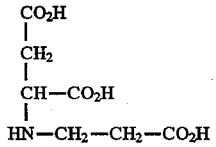

II-3

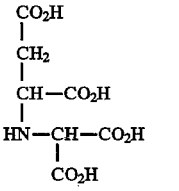

II-4

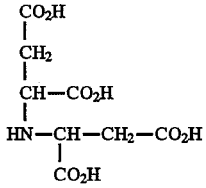

II-5

-continued

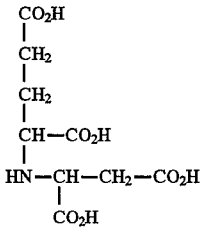

II-6

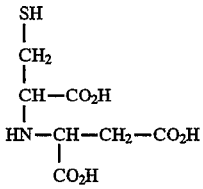

II-7

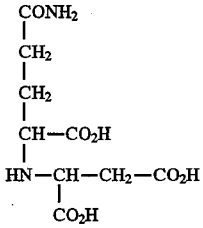

II-8

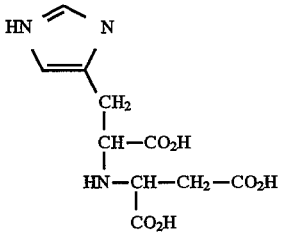

II-9

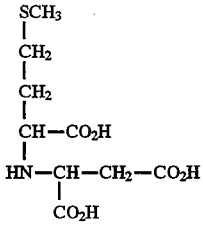

II-10

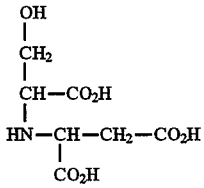

II-11

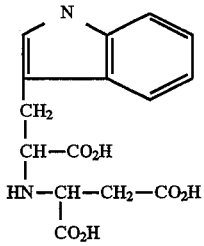

II-12

-continued
II-13
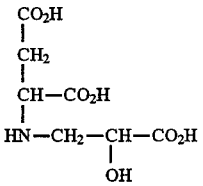
II-14
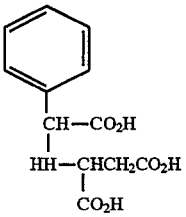
II-15
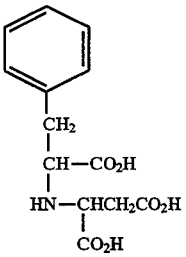
II-16
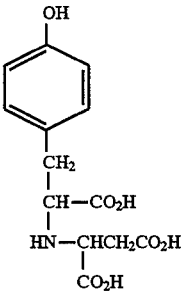
II-17
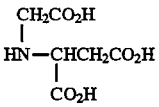
II-18
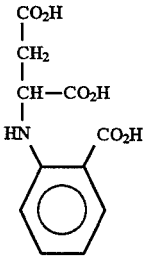
II-19
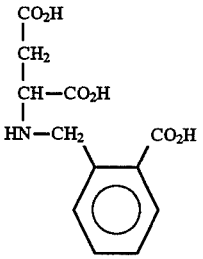
-continued
II-20
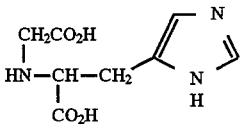
II-21
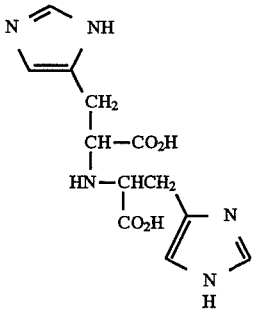
II-22
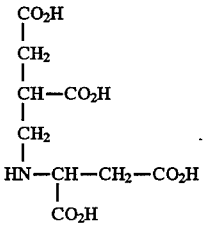
II-23
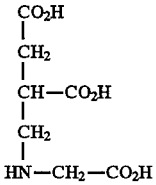
II-24
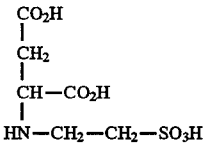
II-25
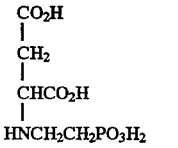
II-26
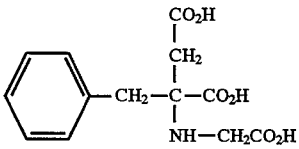
II-27
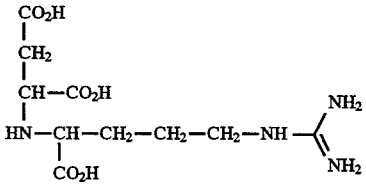

-continued

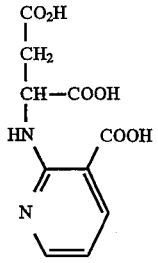

II-28

Of them, Compounds II-1, II-5, II-9, II-14, II-15, II-17, II-20 and II-26 are preferred.

The above-described compounds may be used in the form of an ammonium salt or an alkali metal salt.

The compound represented by formula (II) of the present invention can be synthesized by the synthesis method of aspartic-N-acetic acid described in *Journal of Inorganic and Nuclear Chemistry*, Vol. 35, pp. 523–535 (1973) or Swiss Patent 561,504 or according to the method.

Synthesis Example 1

Synthesis of Compound II-1 (racemic compound)

3.0 g (0.04 mol) of glycine, 7.0 g (0.06 mol) of a maleic acid, 10 ml of water and 17.5 ml (0.123 mol) of an aqueous solution of 7N sodium hydroxide were charged in a three neck distillation flask and heated under reflux for 15 hours in an oil bath while well stirring. After cooling, the mixture was filtered and then 12.5 ml (0.123 mol) of concentrated hydrochloric acid was added to the filtrate.

The precipitated crystals of a fumaric acid and a maleic acid were separated by filtration and the filtrate was transferred to a separating funnel. 50 ml of ethyl ether was poured into the separating funnel and after thorough agitation, it was concentrated under reduced pressure to reduce the aqueous layer to 20 ml. The precipitated salt was removed and the residue was adjusted to have a pH of 2.1 with an aqueous solution of 5N sodium hydroxide. The resulting solution was kept in a refrigerator for 2 days and the precipitated crystal was recovered by filtration and then washed with methanol and acetone. The washed crystal was dried under reduced pressure and then 3.4 g ($1.78\times10^{-2}$ mol) of the desired compound II-1 was obtained. Yield: 44%

The structure was identified by the NMR spectrum and the elemental analysis.

mp: 171°–174° C.

Elemental analysis for $C_6H_8NNaO_6.H_2O$

| | H % | C % | N % |
|---|---|---|---|
| Calcd. | 4.36 | 31.18 | 6.06 |
| Found | 4.21 | 30.98 | 6.10 |

$^1$H NMR ($D_2O$+NaOD) δppm δ2.38–2.68 (m, 2H) δ3.30 (d, 2H) δ3.45–3.55 (m, 1H)

The ferric complex salt of the compound represented by formula (I) or (II) of the present invention may be an isolated metal chelate compound or one obtained by reacting the compound represented by formula (I) or (II) with an iron salt (e.g., ferric sulfate, ferric chloride, ferric nitrate, ferric phosphate) in a solution. Also, it may be one obtained by reacting an ammonium salt or an alkali metal salt (e.g., lithium salt, sodium salt, potassium salt) of the compound represented by formula (I) or (II) with the above-described metal salt in a solution.

In the present invention, of the ferric complex salts of the compounds represented by formulae (I) and (II), the ferric complex salt of the compound represented by formula (II) is preferred.

The compound represented by formula (I) or (II) is used in an amount of 1.0 or more by molar ratio to the iron ion. The ratio is preferably larger when the stability of the metal chelate compound is low and it is usually in the range between 1 and 30.

The ferric complex salt of the compound represented by formula (I) or (II) of the present invention (hereinafter sometimes referred to as a ferric complex salt of the present invention) is used in an amount of preferably from 0.005 to 1 mol, more preferably from 0.01 to 0.5 mol, and most preferably from 0.05 to 0.5 mol, per liter of the processing solution having bleaching ability (a bleaching solution or a bleach-fixing solution). Also, the ferric complex salt of the present invention can exert excellent performance even when it is used at a dilute concentration such as of from 0.005 to 0.2 mol, preferably from 0.01 to 0.2 mol, more preferably from 0.05 to 0.18 mol, per liter of the processing solution.

The compound represented by formula (III) will be described below in detail.

The nitrogen-containing heterocyclic ring formed by Q is a saturated or unsaturated 3- to 10-membered heterocyclic group having a nitrogen atom as the hetero atom, and it may be monocyclic or may form a condensed ring with another aromatic or heterocyclic ring. The nitrogen-containing heterocyclic ring is preferably a 5- or 6-membered nitrogen-containing unsaturated heterocyclic ring and more preferably a 5- or 6-membered nitrogen-containing aromatic heterocyclic group. Examples of preferred nitrogen-containing heterocyclic rings include pyridine, pyrazine, pyrimidine, pyridazine, pyrrole, imidazole, pyrazole, thiazole, oxazole, triazole, thiadiazole, triazine and indole. Among them, pyridine, imidazole and pyrazine are more preferred and pyridine is most preferred. The nitrogen-containing heterocyclic ring formed by Q may have a substituent and examples of the substituent include those described for the substituent which the aliphatic group for $R_1$, $R_2$, $R_3$, $R_4$ or $R_5$ in formula (I) may have.

p represents 0 or 1 and preferably 0. $M_4$ has the same meaning as $M_1$ or $M_2$ in formula (I).

Specific examples of the compound represented by formula (III) will be described below, but the present invention is by no means limited thereto.

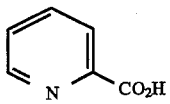

III-1

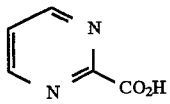

III-2

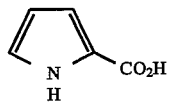

III-3

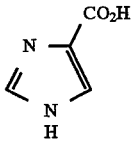

III-4

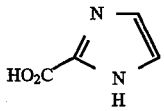

III-5

-continued

III-6

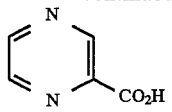

III-7

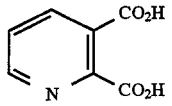

III-8

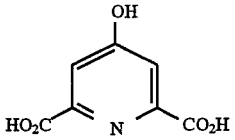

III-9

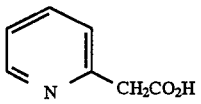

III-10

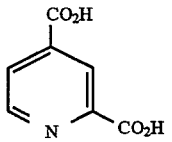

III-11

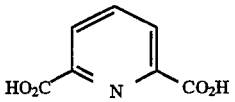

III-12

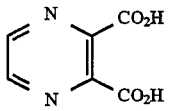

III-13

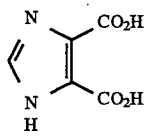

III-14

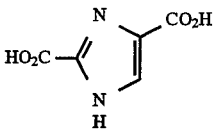

III-15

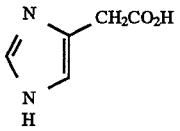

III-16

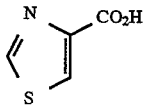

III-17

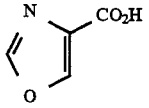

III-18

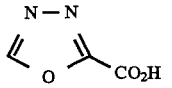

-continued

III-19

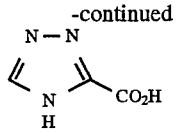

III-20

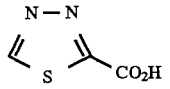

III-21

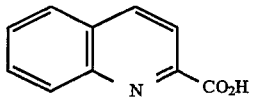

III-22

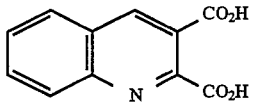

III-23

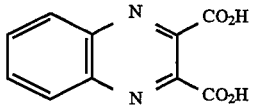

III-24

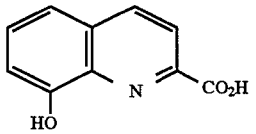

III-25

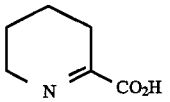

The above-described compounds may be used in the form of an ammonium salt or an alkali metal salt.

These compounds represented by formula (III) can be synthesized according to the method described in *Organic Syntheses Collective Volume*, Item 3,740, or commercially available products may be used.

Among compounds represented by formula (III), 2-carboxypyridine, 2-carboxypyrazine, 2-carboxyimidazole, 4-carboxyimidazole and derivatives thereof are preferred and 2-carboxypyridine is most preferred.

The compound represented by formula (III) of the present invention is added in an amount of preferably from 0.001 to 0.3 mol, more preferably from 0.01 to 0.20 mol, most preferably from 0.05 to 0.15 mol, per liter of the processing solution having bleaching ability. The compound used in an amount of this range can exert superior performance.

As a means for improving desilvering property, a combination use of an iron complex of an organic chelating agent and a 2-carboxypyridine is disclosed in JP-B-51-29015 (the term "JP-B" as used herein means an "examined Japanese patent publication"). However, this bleaching agent exhibits insufficient bleaching performance in rapid processing and readily causes stains, thus it can hardly achieve the object of the present invention.

According to the processing method of the present invention, even with a bleaching agent having excellent biodegradability, the developed silver can be bleached very rapidly and photographically adverse effects such as a stain can be suppressed.

The inventive characteristics of the present invention resides in the processing of a silver halide color photographic material with a processing solution having bleaching ability and other factors such as materials and the like can be appropriately selected from those used in general.

In the case where the processing solution having bleaching agent of the present invention contains a ferric complex salt as the bleaching agent, other bleaching agents may be used in combination in an amount of such a range as can extract the effect of the present invention (preferably 0.01 mol or less, more preferably 0.005 mol or less, per liter of the processing solution). Examples of the bleaching agent used in combination include Fe(II), Co(III) or Mn(III) chelated bleaching agents, persulfates (e.g., peroxodisulfate), hydrogen peroxides and bromates, of compounds described below.

Examples of the compound capable of forming the above-described chelated bleaching agents include ethylenediaminetetraacetic acid, diethylenetriaminepentaacetic acid, ethylenediamine-N-(β-hydroxyethyl)-N,N',N',-triacetic acid, 1,2-diaminopropanetetraacetic acid, 1,3-diaminopropanetetraacetic acid, nitrilotriacetic acid, cyclohexanediaminetetraacetic acid, iminodiacetic acid, dihdyroxyethylglycine, ethyl ether diaminetetraacetic acid, glycol ether diaminetetraacetic acid, ethylenediaminetetrapropionic acid, phenylenediaminetetraacetic acid, N-(2-carboxymethoxyphenyl)iminodiacetic acid, β-alaninediacetic acid, glycinedipropionic acid, ethylenediamine-N,N'-disuccinic acid, 1,3-propylenediamine-N,N'-disuccinic acid, 1,3-diaminopropanol-N,N,N',N'-tetramethylenephosphonic acid, ethylenediamine-N,N,N',N'-tetramethylenephosphonic acid, 1,3-diaminopropane-N,N,N',N'-tetramethylenephosphonic acid, nitrilodiacetic monopropionic acid, nitrilomonoacetic dipropionic acid, 2-hydroxy-3-aminopropionic-N,N-diacetic acid, serine-N,N-diacetic acid, 2-methylserine-N,N-diacetic acid, 2-hydroxymethylserine-N,N-diacetic acid, hydroxyethyliminodiacetic acid, methyliminodiacetic acid, N-(2-acetamido)iminodiacetic acid, nitrilotripropionic acid, ethylenediaminediacetic acid, ethylenediaminedipropionic acid, 1,4-diaminobutanetetraacetic acid, 2-methyl-1,3-diaminopropanetetraacetic acid, 2,2-dimethyl-1,3-diaminopropanetetraacetic acid, citric acid and an alkali metal salt (e.g., lithium salt, sodium salt, potassium salt) or an ammonium salt of these, and also include bleaching agents described in JP-A-63-80256, JP-A-63-97952, JP-A-63-97953, JP-A-63-97954, JP-A-1-93740, JP-A-3-216650, JP-A-3-180842, JP-A-4-73645, JP-A-4-73647, JP-A-4-127145, JP-A-4-134450, JP-A-4-174432, EP-A-430000 and West German Patent (OLS) No. 3,912,551.

The processing solution having bleaching ability of the present invention preferably contains a halide such as chloride, bromide and iodide as a rehalogenating agent for accelerating the oxidation of silver. Further, the processing solution may contain an organic ligand capable of forming a sparingly soluble silver salt in place of a halide. The halide is added in the form of an alkali metal salt, an ammonium salt or a salt such as guanidine or amine. Specific examples thereof include sodium bromide, ammonium bromide, potassium chloride, guanidine hydrochloride, potassium bromide and potassium chloride. The rehalogenating agent is added to the processing solution having bleaching ability of the present invention in an amount suitably of 2 mol/l or less. When the processing solution is a bleaching solution, it is preferably added in an amount of from 0.01 to 2.0 mol/l, more preferably from 0.1 to 1.7 mol/l most preferably from 0.1 to 0.6 mol/l, and in the case of a bleach-fixing solution, in an amount preferably of from 0.001 to 2.0 mol/l, more preferably from 0.001 to 1.0 mol/l, most preferably from 0.001 to 0.5 mol/l.

The processing solution having bleaching ability of the present invention may contain the compound represented by formula (I)separately from that for the ferric complex salt of the present invention. The addition amount of the compound is preferably larger as the stability of the metal chelating compound is lower and it is usually in the range between 0 to 30-fold molar weight.

In addition, the processing solution having bleaching ability of the present invention contains a bleaching accelerator, an anticorrosive for preventing corrosion of the processing bath, a fluorescent brightener or a defoaming agent, if desired.

Examples of the bleaching accelerator include compounds having a mercapto group or a disulfide group described in U.S. Pat. No. 3,893,858, German Patent 1,290,812, British Patent 1,138,842, JP-A-53-95630 and *Research Disclosure* No. 17129 (1978), thiazolidine derivatives described in JP-A-50-140129, thiourea derivatives described in U.S. Pat. No. 3,706,561, iodides described in JP-A-58-16235, polyethylene oxides described in German Patent 2,748,430, polyamine compounds described in JP-B-45-8836 and imidazole compounds described in JP-A-49-40493. Among them, mercapto compounds described in British Patent 1,138,842 are preferred.

As the anticorrosive, a nitrate is preferred and specifically, ammonium nitrate, sodium nitrate or potassium nitrate is used. The addition amount thereof is from 0.01 to 2.0 mol/l, preferably from 0.05 to 0.5 mol/l.

The bleaching or bleach-fixing solution of the present invention has a pH of from 2.0 to 8.0, preferably from 3.0 to 7.5. In the case when the bleaching or bleach-fixing is conducted immediately after color development of a photographic material for photographing, the pH of the solution is 7.0 or less, preferably 6.4 or less, so as to inhibit bleach fogging. In particular, the pH of the bleaching solution is preferably from 3.0 to 5.0. If the pH is 2.0 or less, the metal chelating in the present invention readily becomes unstable and therefore, the pH is preferably from 2.0 to 6.4. In the case of a color printing material, the pH is preferably from 3 to 7.

Accordingly, as the pH buffer agent, those hardly susceptible to oxidation due to the bleaching agent and capable of effecting buffering action in the above-described pH range may be used in combination, other than the compound represented by formula (III). Examples thereof include organic acids such as acetic acid, glycolic acid, lactic acid, propionic acid, butyric acid, malic acid, chloroacetic acid, levulinic acid, ureidopropionic acid, formic acid, monobromoacetic acid, monochloropropionic acid, pyruvic acid, acrylic acid, isobutyric acid, pivalic acid, aminobutyric acid, valeric acid, isovaleric acid, asparagine, alanine, arginine, ethionine, glycine, glutamine, cysteine, serine, methionine, leucine, histidine, benzoic acid, chlorobenzoic acid, hydroxybenzoic acid, nicotinic acid, oxalic acid, malonic acid, succinic acid, tartaric acid, maleic acid, fumaric acid, oxalo acid, glutaric acid, adipic acid, aspartic acid, glutamic acid, cystein, ascorbic acid, phthalic acid, terephthalic acid and salicylic acid, and organic bases such as pyridine, dimethylpyrazole, 2-methyl-o-oxazoline, aminoacetonitrile and imidazole. A plurality of these buffer agents may be used in combination. In the present invention, preferred is an organic acid having a pKa of from 2.0 to 5.5 and particularly preferred are acetic acid, glycolic acid, malonic acid, succinic acid, maleic acid fumaric acid, glutaric acid, adipic acid and a combination of two or more of these. These organic acids may be used in the form of an alkali metal salt (e.g., lithium salt, sodium salt, potassium salt) or an ammonium salt. The buffer agent other than the compound represented by formula (III) is suitably used in an amount in total of from 0.001 to 1.5 mol, preferably from 0.001 to 1.0 mol, particularly preferably from 0.004 to 0.8 mol, per liter of the processing solution having bleaching ability.

In order to adjust the pH of the processing solution having bleaching ability to lie in the above-described range, the above-described acid and an alkali agent (e.g., aqueous ammonia, KOH, NaOH, potassium carbonate, sodium carbonate, imidazole, monoethanolamine, diethanolamine) may be used in combination. Among these, preferred are aqueous ammonia, KOH, NaOH, potassium carbonate and sodium carbonate.

Recently, the recognition of environmental conservation is increasing and accordingly, they are endeavoring to reduce the nitrogen atom exhausted into the environment. In this point of view, the processing solution of the present invention is also desired to contain substantially no ammonium ion.

In the present invention, "to contain substantially no ammonium ion" means that the concentration of ammonium ions is 0.1 mol/l or less, preferably 0.08 mol/l or less, more preferably 0.01 mol/l or less, and most preferably zero.

In order to reduce the ammonium ion concentration to the range of the present invention, an alternative cation is used and alkali metal ions or alkaline earth metal ions are preferred therefor. The alkali metal ions are particularly preferred and among them, lithium ion, sodium ion and potassium ion are preferred. Specific examples thereof include a sodium salt and a potassium salt of an organic acid ferric complex as a bleaching agent, potassium bromide and sodium bromide as a rehalogenating agent in the processing solution having bleaching ability, and also potassium nitrate and sodium nitrate.

As the alkali agent for adjusting the pH, potassium hydroxide, sodium hydroxide, potassium carbonate and sodium carbonate are preferred.

The processing solution having bleaching ability of the present invention is particularly preferably subjected to aeration at the processing because the photographic performance can be sustained thereby extremely stably. The aeration can be conducted by a means known in the art and specifically, the air is blown or absorbed using an ejector into the processing solution having bleaching ability.

In blowing the air, the air is preferably released into the solution through an air diffusion tube having fine pores. Such an air diffusion tube is widely used, for example, in an aeration tank for processing sludge. With respect to the aeration, *Z*-121, *Using Process C*-41, 3rd ed. (1982), pp. BL-1 to BL-2, published by Eastman Kodak Co. can be referred to. In the processing using the processing solution having bleaching ability of the present invention, the stirring is preferably intensified and the intensification of stirring can be conducted in accordance with the disclosure in JP-A-3-33847 at page 8, from right upper column, line 6 to left lower column, line 2 without any modification.

The bleaching or bleach-fixing may be conducted at a temperature of from 30° to 60° C. but it is preferably conducted at a temperature of from 35° to 50° C.

The processing time in bleaching and/or bleach-fixing may be from 10 seconds to 7 minutes in the case of a photographic material for photographing, but it is preferably from 10 seconds to 4 minutes. In the case of a printing material, it is from 5 to 70 seconds, preferably from 5 to 60 seconds, more preferably from 10 to 45 seconds. Under such preferred conditions, good results such as rapid processing and no increase of stains can be achieved.

The photographic material processed with a processing solution having bleaching ability is subjected to fixing or bleach-fixing. Preferred examples of the fixing or bleach-fixing solution is also described in JP-A-3-33847, from page 6, right lower column, line 16 to page 8, left upper column, line 15.

As the fixing agent in desilvering, ammonium thiosulfate is usually used but other known fixing agents such as meso-ionic compounds, thioether compounds, thioureas, a large amount of iodides or hypo may be used therefor. JP-A-60-61749, JP-60-147735, JP-A-64-21444, JP-A-1-201659, JP-A-1-210951, JP-A-2-44355 and U.S. Pat. No. 4,378,424 describe them. Examples thereof include ammonium thiosulfate, sodium thiosulfate, potassium thiosulfate, guanidine thiosulfate, ammonium thiocyanate, sodium thiocyanate, potassium thiocyanate, dihydroxyethylthioether, 3,6-dithia-1,8-octanediol and imidazole. Among them, a thiosulfate and a meso-ion are preferred. From the standpoint of rapid fixing, an ammonium thiosulfate is preferred but, as described above, the processing solution is demanded to contain substantially no ammonium ion in view of environmental issue and accordingly, a sodium thiosulfate and a meso-ion are more preferred. Also, more rapid fixing may be carried out by a combination use of two or more fixing agents. For example, in addition to ammonium thiosulfate or sodium thiosulfate, the above-described ammonium thiocyanate, imidazole, thiourea or thioether is preferably used in combination. In this case, the second fixing agent is preferably added in an amount of from 0.01 to 100 mol% based on the ammonium thiosulfate or sodium thiosulfate.

The addition amount of the fixing agent is from 0.1 to 3.0 mol, preferably from 0.5 to 2.0 mol, per liter of the bleach-fixing or fixing solution. The pH of the fixing solution varies depending upon the kind of the fixing agent but it is generally from 3.0 to 9.0 and in particular, when a thiosulfate is used, the pH is preferably from 5.8 to 8.0 so as to obtain stable fixing.

The bleach-fixing or fixing solution may contain a preservative for increasing aging stability of the solution. In the case of a bleach-fixing or fixing solution containing a thiosulfate, an effective preservative is sulfite and/or a bisulfite adduct of hydroxylamine, hydrazine or aldehyde (e.g., a bisulfite adduct of acetaldehyde, particularly preferably, a bisulfite adduct of aromatic aldehyde described in JP-A-1-298935). Sulfinic acid compounds described in JP-A-62-143048 may also be preferably used.

The bleach-fixing or fixing solution preferably contains a buffer agent so as to keep the pH of the solution constant. Examples thereof include phosphate, imidazoles such as imidazole, 1-methylimidazole, 2-methylimidazole and 1-ethylimidazole, triethanolamine, N-allylmorpholine and N-benzoylpiperazines.

In order to enhance the effect of the present invention, after processing the imagewise exposed silver halide color photographic material with the processing solution having bleaching ability, it is preferably processed further with a processing solution having fixing ability and containing an aminopolycarboxylic acid and/or an organic phosphonic acid.

Examples of the aminopolycarboxylic acid and the organic phosphonic acid include ethylenediamine-N,N'-disuccinic acid, 1,3-propylenediamine-N,N'-disuccinic acid, 1-hydroxyethylidene-1,1-diphosphonic acid, nitrilotrimethylene phosphonic acid, 2-hydroxy-1,3-diaminopropanetetraacetic acid, ethylenediaminetetraacetic acid, diethylenetriaminepentaacetic acid, ethylenediamine-N-(β-hydroxyethyl)-N,N',N'-triacetic acid, 1,2-diaminopropanetetraacetic acid, 1,3-diaminopropanetetraacetic acid, nitrilotriacetic acid, cyclohexanediaminetetraacetic acid, iminodiacetic acid, N-(2-carboxyphenyl)iminodiacetic acid, dihydroxyethylglycine, ethyletherdiaminetetraacetic acid, glycol ether diaminetetraacetic acid, ethylenediaminetetrapropionic acid, glycinedipropionic acid, phenylenediaminetetraacetic acid, 1,3-diaminopropanol-N,N,N',N'-tetramethylene phosphonic acid, ethylenediamine-N,N,N',N'-tetramethylene phosphonic acid, 1,3-propanediamine-N,N,N',N'-tetramethylene phosphonic acid, serine-N,N-diacetic acid, 2-methylserine-N,N-diacetic acid, 2-hydroxymethylserine-N,N-diacetic acid, hydroxyethyliminodiacetic acid, methyliminodiacetic acid, N-(2-acetamido)-iminodiacetic acid, nitrilotripropionic acid, ethylenediaminediacetic acid, ethylenediaminedipropionic acid, 1,4-diaminobutanetetraacetic acid, 2-methyl-1,3-diaminopropanetetraacetic acid, 2,2-dimethyl-1,3-diaminopropanetetraacetic acid, β-alaninediacetic acid, alanine, tartaric acid, hydrazinediacetic acid, N-hydroxyiminodipropionic acid and an alkali metal salt (e.g., lithium salt, sodium salt, potassium salt) or an ammonium salt of these.

The above-described aminopolycarboxylic acid or organic phosphonic acid is preferably added in an amount of from 0.0001 to 0.5 mol/l, more preferably from 0.01 to 0.1 mol/l.

The fixing may be conducted at a temperature of from 30° to 60° C. but it is preferably conducted at a temperature of from 35° to 50° C.

The processing time in fixing is from 15 seconds to 2 minutes, preferably from 25 seconds to 1 minute and 40 seconds for the photographic material for photographing and from 8 to 80 seconds, preferably from 10 to 45 seconds for the printing material.

The desilvering usually comprises a combination of bleaching, bleach-fixing or fixing. Specific examples thereof are as follows:

(1) bleaching and fixing (2) bleaching and bleach-fixing (3) bleaching, bleach-fixing and fixing (4) bleaching, washing and fixing (5) bleach-fixing (6) fixing and bleach-fixing For the photographic material for photographing, combinations (1), (2), (3) and (4) are preferred and combinations (1), (2) and (3) are more preferred. For the printing material, combination (5) is preferred.

The present invention can also be applied to desilvering through, for example, an adjusting bath, a stopping bath and a washing bath after color development.

The processing method of the present invention is preferably practiced in an automatic processor. The conveying method in such an automatic processor is described in JP-A-60-191257, JP-A-60-191258 and JP-A-60-191259. In conducting a rapid processing, the cross-over time between processing tanks in the automatic processor is preferably shortened. JP-A-1-319038 describes an automatic processor in which the cross-over time is 5 seconds or less.

In conducting a continuous processing according to the processing method of the present invention in an automatic processor, replenishers are preferably supplied in correspondence with the amount of the processed photographic material so as to compensate the consumed components of the processing solution accompanying the processing of the photographic material or to prevent the accumulation of undesired components eluted from the photographic material in the processing solution. Each processing step may consist of two or more processing baths and in this case, a counter-current system is preferably employed in which the replenisher flows from the post-bath into the pre-bath. In particular, the washing or stabilization step is preferably in a 2- to 4-stage cascade fashion.

The replenishing amount is preferably reduced as long as the change in composition of each processing solution does not cause any inconvenience on the photographic performance or not cause staining of solutions.

In the present invention, the stirring of each processing solution is preferably intensified as strong as possible so as to achieve the effect of the present invention more effectively.

Specific examples of the method for intensifying the stirring include a method described in JP-A-62-183460, JP-A-62-183461 and JP-A-3-33847, page 8, which comprises bringing a jet stream of the processing solution into collision with the emulsion layer surface of the photographic material as applied to the color negative film processor EP-560B manufactured by Fuji Photo Film Co., Ltd., a method of increasing the stirring effect using a rotary means described in JP-A-62-183461, a method of improving the stirring effect by transferring a photographic material (film) while putting a wiper blade provided in the solution into contact with the emulsion layer surface to thereby form a turbulent flow on the emulsion layer surface and a method of increasing the circulating flow rate of the entire processing solutions. Among these, a method of bringing a jet stream of the processing solution into collision with the emulsion layer surface is most preferred and this method is preferably applied to all of processing tanks.

The replenishing amount of the color developer is, in the case of a silver halide color photosensitive material for photographing , from 50 ml to 3,000 ml, preferably from 50 to 2,200 ml, per $m^2$ of the photographic material and, in the case of a color printing material, it is from 15 to 500 ml, preferably 20 to 350 ml, per $m^2$ of the photographic material.

The replenishing amount of the bleaching solution is, in the case of a silver halide color photosensitive material for photographing, from 10 to 1,000 ml, preferably from 50 to 550 ml, per $m^2$ of the photographic material and, in the case of a printing material, it is from 15 to 500 ml, preferably from 20 to 300 ml, per $m^2$ of the photographic material.

The replenishing amount of the bleach-fixing solution is, in the case of a silver halide color photosensitive material for photographing, from 200 to 3,000 ml, preferably from 250 to 1,300 ml, per $m^2$ of the photographic material and, in the case of a printing material, it is from 20 to 300 ml, preferably from 50 to 200 ml, per $m^2$ of the photographic material. The bleach-fixing solution may be replenished as a sole solution or may be replenished dividedly as a bleaching composition and a fixing composition, or the overflow solutions from a bleaching bath and/or a fixing bath may be mixed to serve as the replenisher of the bleach-fixing solution.

The replenishing amount of the fixing solution is, in the case of a silver halide color photosensitive material for photographing, from 300 to 3,000 ml, preferably from 300 to 1,200 ml, per $m^2$ of the photographic material and, in the case of a color printing material, it is from 20 to 300 ml, preferably from 50 to 200 ml, per $m^2$ of the photographic material.

The replenishing amount of the washing water or the stabilization solution is from 1 to 50 times, preferably from 2 to 30 times, more preferably from 2 to 15 times the amount carried over from the pre-bath per unit area.

The overflow of the processing solution having bleaching ability of the present invention may be recovered after the processing and reused by adding components thereto to correct the composition. Such a way of use is called regeneration and the regeneration is also preferably employed in the present invention. With respect to the regeneration, the disclosure in *Fuji Film Processing Manual, Fuji Color Negative Film, CN*-16 *Shori* (revised in August, 1990), pp. 39–40, published by Fuji Photo Film Co., Ltd., can be referred to.

The kit for regulating the processing solution having bleaching ability of the present invention may be liquid or powder and in the case where an ammonium salt is eliminated, almost all materials are fed in the form of powder and they can be easily formulated into powder due to small hygroscopicity.

The kit for the above-described regeneration is preferably in the form of powder so as to reduce the amount of waste solution because it requires no extra water and can be added directly.

With respect to the regeneration of the processing solution having bleaching ability, the above-described aeration or the method described in *Shashin Kogaku no Kiso-Gin-en Shashin Hen* (compiled by Nippon Shashin Gakkai, Corona Sha, 1979) can be used. Specific examples thereof include electric field regeneration and regeneration methods of the bleaching solution with bromic acid, chlorous acid, bromine, bromine precursor, persulfate, hydrogen peroxide, hydrogen peroxide using a catalyst, bromous acid, ozone, etc.

In the electric field regeneration, the regeneration is carried out by placing an anode and a cathode in the same bleaching bath or by dividing an anode cell and a cathode cell into separate baths with the use of a diaphragm, or the bleaching solution and the developer and/or the fixing solution are simultaneously subjected to regeneration also with the use of diaphragm.

The fixing solution or the bleach-fixing solution is regenerated by the electrolytic reduction of accumulated silver ions. In addition, it is also preferred to remove accumulated halogen ions by an anionic exchange resin so as to maintain the fixing performance.

In order to reduce the use amount of washing water, ion exchanging or ultrafiltration is employed and the ultrafiltration is particularly preferred.

In the present invention, the color photographic material is subjected to color development after imagewise exposure and before desilvering. The color developer which can be used in the present invention include those described in JP-A-3-33847, from page 9, left upper column, line 6 to page 11, right lower column, line 6, and JP-A-5-197107.

The color developing agent used in the color development may be a known aromatic primary amine color developing agent and preferred examples thereof include p-phenylenediamine derivatives such as 4-amino-N-ethyl-N-(β-hydroxyethyl)-3-methylaniline, 4-amino-N-ethyl-N-(3-hydroxypropyl)-3-methylaniline, 4-amino-N-ethyl-N-(4-hydroxybutyl)-3-methylaniline, 4-amino-N-ethyl-N-(β-methanesulfonamidoethyl)-3-methylaniline, 4-amino-N-(3-carbamoylpropyl-N-n-propyl-3-methylaniline and 4-amino-N-ethyl-N-(β-hydroxyethyl)-3-methoxyaniline, and those described in EP-A-410450 and JP-A-4-11255.

Salts of the p-phenylenediamine derivative with sulfate, hydrochloric acid salt, sulfite, naphthalenedisulfonic acid or p-toluenesulfonic acid may also be used. The aromatic primary amine developing agent is preferably used in an amount of from 0.0002 mol to 0.2 mol, more preferably from 0.001 mol to 0.1 mol, per liter of the color developer.

The processing temperature for the color developer in the present invention is from 20° to 55° C., preferably from 30° to 55° C. The processing time is, in the case of a photographic material for photographing, from 20 seconds to 5 minutes, preferably 30 seconds to 3 minutes and 20 seconds, more preferably from 1 minute to 2 minutes and 30 seconds, and in the case of a printing material, it is from 10 seconds to 1 minute and 20 seconds, preferably from 10 to 60 seconds, more preferably from 10 to 40 seconds.

The processing method of the present invention can also be used in color reversal processing. The black-and-white developer used in this case is one called black-and-white first developer used in conventionally known reversal processing of a color photographic material. The black-and-white first developer of the color reversal photographic material may contain various well-known additives added to and used in the black-and-white developer for use in the processing solution of a black-and-white silver halide photographic material.

Representative additives include a developing agent such as 1-phenyl-3-pyrazolidone, metol and hydroquinone, a preservative such as sulfite, an accelerator comprising an alkali such as sodium hydroxide, sodium carbonate and potassium carbonate, an inorganic or organic inhibitor such as potassium bromide, 2-methylbenzimidazole and methylbenzothiazole, a hard water softener such as polyphosphate, and a development inhibitor comprising a very small amount of iodide or a mercapto compound.

In the present invention, the desilvered photographic material is subjected to washing and/or stabilization. In the washing and stabilization, a stabilizing solution described in U.S. Pat. No. 4,786,583 is used. Further, in the stabilizing solution., formaldehyde is used as a stabilizer but in view of safety in the working environment, N-methylolazolehexamethylenetetramine, a formaldehyde-bisulfite adduct, dimethylolurea and an azolylmethylamine derivative are preferred. These are described in JP-A-2-153348, JP-A-4-270344 and EP-A-504609. In particular, an azole such as 1,2,4-triazole and azolylmethylamine such as 1,4-bis(1,2,4-triazole-1-ylmethyl)piperazine or a derivative thereof are preferably used in combination because a high image stability is provided and the formaldehyde vapor pressure is low.

The photographic material which can be applied to the processing of the present invention may be a color negative film, color reversal film, color paper, color reversal paper, direct positive color photographic material, color negative film for movies or color positive film for movies and examples thereof are described in JP-A-3-33847, JP-A-3-293662 and JP-A-4-130432. There is no particular limitation on the support of the photographic material used in the present invention, the coating method, the kind of silver halide (e.g., silver iodobromide, silver iodochlorobromide, silver bromide, silver chlorobromide, silver chloride) used in a silver halide emulsion layer or a surface protective layer, the grain form thereof (e.g., cubic, tabular, sphere), the grain size thereof, the fluctuation (variation) ratio thereof, the crystalline structure thereof (e.g., core/shell structure, multiphase structure, uniform phase structure), the production method thereof (e.g., single jet process, double jet process), the binder (e.g., gelatin), the hardener, the antifoggant, the metal-doping agent, the silver halide solvent, the tackyfying agent, the emulsion precipitant, the dimension stabilizer, the adhesion inhibitor, the stabilizer, the contamination inhibitor, the dye image stabilizer, the stain inhibitor, the chemical sensitizer, the spectral sensitizer, the sensitivity increasing agent, the supersensitizer, the nucleating agent, the coupler (e.g., pivaloylacetanilide-based and benzoylacetanilide-based yellow couplers, 5-pyrazolone-based and pyrazoloazole-based magenta couplers, phenolic and naphthol-based cyan couplers, DIR couplers, bleaching accelerator-releasing couplers, competitive couplers, colored couplers), the coupler dispersion method/e.g., oil-in-water dispersion method using a high boiling point solvent), the plasticizer, the antistatic agent, the lubricant, the coating aid, the surface active agent, the whitening agent, the formalin scavenger, the light-scattering agent, the matting agent, the light absorbent, the ultraviolet light absorbent, the filter dye, the irradiation dye, the development improver, the delustering agent, the antiseptic (e.g., 2-phenoxyethanol) and the antimold, and disclosures, for example, in *Product Licensing*, Vol. 92, pp. 107–110 (December, 1971), *Research Disclosure* (hereinafter referred to as RD), No. 17643 (December, 1978), RD, No. 18716 (November, 1976) and RD, No. 307105 (November, 1989) may also be referred to.

The processing composition of the present invention may be used for any color photographic material but, in the present invention, the dry thickness of all constituent layers exclusive of the support of the color photographic material and the subbing layer and the backing layer of the support is, in the case of a color photographic material for photographing, preferably 20.0 μm or less, more preferably 18.0 μm, for achieving the object of the present invention, and in the case of a printing material, it is 16.0 μm or less, more preferably 13.0 μm or less.

If the layer thickness is outside the above-described range, the bleach fogging ascribed to the developing agent remaining after color development or stains after processing increase. The generation of bleach fogging or stains is deduced from the green-sensitive layer and is prone to cause the greater increase in magenta color as compared with the increase in other cyan or yellow colors.

The lower limit of the layer thickness is preferably determined by reducing from the above-described definition in such a range that the performance of the photographic material is not conspicuously impaired. The lower limit of the dry thickness of all constituent layers exclusive of the support of the photographic material and the subbing layer of the support is, in the case of a color photographic material for photographing, 12.0 μm and in the case of a printing material, it is 7.0 μm. In the case of a photographic material for photographing, a layer is usually provided between a light-sensitive layer closest to the support and the subbing layer of the support, and the total dry thickness of the layer (or a plurality of layers) is 1.0 μm. The reduction of the layer thickness may be done in either light-sensitive layers or light-insensitive layers.

The swelling ratio [equilibrium thickness of swollen layers in $H_2O$ at 25° C.—dry thickness of entire layers at 25° C. and 55% RH/dry thickness of entire layers at 25° C. and 55% RH)×100] of the color photographic material used in the present invention is preferably from 50 to 200%, more preferably from 70 to 150%. If the swelling ratio is outside the above-described values, the amount of the residual color developing agent increases and also the photographic performance, the image quality such as desilvering property and the physical property of the layer such as layer strength may be adversely affected.

Further, with respect to the swelling rate of the color photographic material used in the present invention, when the time required for the thickness to reach a half of the saturation swollen layer thickness which is 90% of the maximum swollen layer thickness in the color developer (30° C., 3 minutes and 15 seconds) is defined as the swelling rate T1/2, T1/2 is preferably 15 seconds or less, more preferably 9 seconds or less.

The silver halide contained in photographic emulsion layers of the color photographic material used in the present invention may have any silver halide composition. For example, silver chloride, silver bromide, silver chlorobromide, silver iodobromide, silver iodochloride or silver iodochlorobromide is used.

In the case of a color photographic material for photographing or a color reversal photographic material (e.g., color negative film, reversal film, color reversal paper), silver iodobromide, silver iodochloride and silver iodochlorobromide, each having a silver iodide content of from 0.1 to 30 mol %, are preferred. In particular, silver iodobromide having a silver iodide content of from 1 to 25 mol % is preferred. In the case of a direct positive color photographic material, silver bromide and silver chlorobromide are preferred and silver chloride is also preferred for carrying out a rapid processing. In the case of a photographic material for paper, silver chloride and silver chlorobromide are preferred and in particular, silver chlorobromide having a silver chloride content of preferably 80 mol % or more, more preferably 95 mol % or more, most preferably 98 mol % or more is preferred.

The color photographic material applied to the processing according to the present invention may contain various color couplers. Specific examples thereof are described in patents cited in the above-described RD No. 17643, VII-C to G and ibid., No. 307105, VII-C to G and also described in JP-A-62-215272, JP-A-3-33847, JP-A-2-33144, EP-A-447969 and EP-A-482552.

Examples of the yellow coupler include those described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023, 4,511,649 and. 5,118,599, EP-A-249473, EP-A-0447969, JP-A-63-23145, JP-A-63-123047, JP-A-1-250944 and JP-A-1-213648, and these can be used together as long as they do not impair the effect of the present invention.

Examples of preferred yellow couplers include yellow couplers represented by formula (Y) in JP-A-2-139544, from page 18, left upper column to page 22, left lower column, acylacetamido-based yellow couplers characterized by the acyl group described in JP-A-5-2248 and EP-A-04479699, and yellow couplers described in JP-A-5-27389 and represented by formula (Cp-2) in EP-A-0446863.

As the magenta coupler, 5-pyrazolone-based or pyrazoloazole-based compounds are preferred and those described in U.S. Pat. Nos. 4,310,619 and 4,351,897, EP-A-73636, U.S. Pat. Nos. 3,061,432, 3,725,067, *Research Disclosure* No. 24220 (June, 1984), JP-A-60-33552, *Research Disclosure* No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO88/04795 are more preferred.

Particularly preferred magenta couplers are pyrazoloazole-based magenta couplers represented by formula (I) in JP-A-2-139544, from page 3, right lower column to page 10, right lower column and 5-pyrazolone magenta couplers represented by formula (M-1) in JP-A-2-135944, from page 17, left lower column to page 21, left upper column. Most preferred are the above-described pyrazoloazole-based magenta couplers.

As the cyan coupler, phenolic and naphthol-based couplers are used and those described in U.S. Pat. Nos. 4,052,212, 4,146,396, 4,228,233, 4,296,200, 2,369,929 2,801,171, 2,772,162, 2,895,826, 3,772,002, 3,758,308 4,334,011 and 4,327,173, West German Patent (OLS) 3,329,729, EP-A-0121365, EP-A-0249453, U.S. Pat. Nos. 3,446,622, 4,333,999, 4,775,616, 4,451,559, 4,427,767, 4,690,889, 4,254,212 and 4,296,199, and JP-A-61-42658 are preferred. Further, pyrazoloazole-based couplers described in JP-A-64-553, JP-A-64-554, JP-A-64-555 and JP-A-64-556, pyrrolotriazole-based couplers described in EP-A-0488248 and EP-A-0491197, pyrroloimidazole-based couplers described in EP-A-0456226, pyrazolopyrimidine-based couplers described in JP-A-64-46753, imidazole-based couplers described in U.S. Pat. Nos. 4,818,672 and JP-A-2-33144, cyclic active methylene-based cyan couplers described in JP-A-64-32260 and couplers described in JP-A-183658, JP-A-2-262655, JP-A-2-85851 and JP-A-3-48243 can also be used.

Typical examples of the polymerized dye-forming coupler are described in U.S. Pat. Nos. 3,451,820, 4,080,211, 4,367,282, 4,409,320 and 4,576,910, British Patent 2,102,137 and EP-A-341188.

As the coupler which provides a coloring dye having an appropriate diffusibility, those described in U.S. Pat. No. 4,366,237, British Patent 2,125,570, EP-B-96570 and West German Patent (OLS) No. 3,234,533 are preferred.

Couplers which release a photographically useful residue upon coupling can also be used in the present invention. As the DIR coupler which releases a development inhibitor, those described in patents cited in RD No. 17643, Item VII-F and described in JP-A-57-151944, JP-A-57-154234, JP-A-60-184248, JP-A-63-37346 and U.S. Pat. Nos. 4,248,962 and 4,782,012 are preferred.

As the coupler which imagewise releases a nucleating agent or a development accelerator during development, those described in British Patent 2,097,140, 2,131,188, JP-A-59-157638 and JP-A-59-170840 are preferred.

Examples of the coupler which can be used in the color photographic element of the present invention include competitive couplers described in U.S. Pat. No. 4,130,427, polyvalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A-60-185950 and JP-A-62-24252, couplers which release a dye capable of restoring color after the release described in EP-A-173302, bleaching accelerator-releasing couplers described in RD No. 11449, ibid., No. 24241 and JP-A-61-201247, ligand-releasing couplers described in U.S. Pat. No. 4,553,477, leuco dye-releasing couplers described in JP-A-63-75747 and fluorescent dye-releasing couplers described in U.S. Pat. No. 4,774,181.

Examples of appropriate supports which can be used in the present invention include those described in the above-described *Research Disclosure* (RD) No. 17643, page 28 and ibid., No. 18716, from page 647, right column to page 648, left column.

The present invention can also be applied to the reducer for correcting the silver image composed of halftone and/or line works obtained by developing a silver halide photographic material for printing plate after exposure.

The present invention will be described below in greater detail with reference to examples, butt the present invention is by no means limited thereto.

EXAMPLE 1

Sample 101, a multilayer color photographic material, was prepared by coating in a superposition manner layers each having the following composition on a cellulose triacetate film support provided with a subbing layer.

(Light-Sensitive Layer Composition)

Materials used in respective layers are classified as follows:

ExC: cyan coupler

ExF: dye

ExM: magenta coupler

ExY: yellow coupler

ExS: sensitizing dye

UV: ultraviolet light absorbent

HBS: high boiling point organic solvent

H: gelatin hardener

The numeral corresponding to each component shows the coating amount expressed by the g/m$^2$ unit and with respect to the silver halide, it is the coating amount calculated in terms of silver. With respect to the sensitizing dye, it shows the coating amount in a molar unit per mol of silver halide in the same layer. (Sample 101)

| | |
|---|---|
| First Layer (antihalation layer) | |
| Black colloidal silver | as silver 0.18 |
| Gelatin | 1.40 |
| ExM-1 | 0.18 |
| ExF-1 | $2.0 \times 10^{-3}$ |
| HBS-1 | 0.20 |
| Second Layer (interlayer) | |
| Silver iodobromide emulsion G | as silver 0.065 |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Third Layer (low-sensitivity red-sensitive emulsion layer) | |
| Silver iodobromide emulsion A | as silver 0.25 |
| Silver iodobromide emulsion B | as silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |
| ExC-8 | 0.010 |
| Cpd-2 | 0.025 |
| HBS-1 | 0.10 |
| Gelatin | 0.87 |
| Fourth Layer (medium-sensitivity red-sensitive emulsion layer) | |

-continued

| | |
|---|---|
| Silver iodobromide emulsion D | as silver 0.70 |
| ExS-1 | $3.5 \times 10^{-5}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| Fifth Layer (high-sensitivity red-sensitive emulsion layer) | |
| Silver iodobromide emulsion E | as silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |
| Gelatin | 1.20 |
| Sixth Layer (interlayer) | |
| Cpd-1 | 0.10 |
| HBS-1 | 0.50 |
| Gelatin | 1.10 |
| Seventh Layer (low-sensitivity green-sensitive emulsion layer) | |
| Silver iodobromide emulsion C | as silver 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.72 |
| Eighth Layer (medium-sensitivity green-sensitive emulsion layer) | |
| Silver iodobromide emulsion D | as silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.89 |
| Ninth Layer (high-sensitivity green-sensitive emulsion layer) | |
| Silver iodobromide emulsion E | as silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.40 |
| Tenth Layer (yellow filter layer) | |
| Yellow colloidal silver | as silver 0.030 |
| Cpd-1 | 0.16 |

| | |
|---|---|
| HBS-1 | 0.60 |
| Gelatin | 0.60 |
| Eleventh Layer (low-sensitivity blue-sensitive emulsion layer) | |
| Silver iodobromide emulsion C | as silver 0.18 |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.08 |
| Twelfth Layer (medium-sensitivity blue-sensitive emulsion layer) | |
| Silver iodobromide emulsion D | as silver 0.40 |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| Thirteenth Layer (high-sensitivity blue-sensitive emulsion layer) | |
| Silver iodobromide emulsion F | as silver 1.00 |
| ExS-7 | $4.0 \times 10^{-4}$ |
| ExY-2 | 0.10 |
| ExY-3 | 0.10 |
| HBS-1 | 0.070 |
| Gelatin | 0.86 |
| Fourteenth Layer (first protective layer) | |
| Silver iodobromide emulsion G | as silver 0.20 |
| UV-4 | 0.11 |
| UV-5 | 0.17 |
| HBS-1 | $5.0 \times 10^{-2}$ |
| Gelatin | 1.00 |
| Fifteenth Layer (second protective layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, in order to improve preservability, processability, pressure resistance, anti-mold and antifungal property, antistatic property and coatability, W-1 to W-3, B-4 to B-6, F-1 to F-17, iron salt, lead salt, gold salt, platinum salt, iridium salt and rhodium salt were added in an appropriate amount to each layer.

TABLE 1

| | Average AgI Content (%) | Average Grain Size (μm) | Coefficient of Variation in Grain size (%) | Diameter/ Thickness Ratio | Silver Amount Ratio [core/middle/shell] (AgI content) | Grain Structure/Shape |
|---|---|---|---|---|---|---|
| Emulsion A | 4.0 | 0.45 | 27 | 1 | [1/3] (13/1) | double structure, octahedral grain |
| Emulsion B | 8.9 | 0.70 | 14 | 1 | [3/7] (25/2) | double structure, octahedral grain |
| Emulsion C | 2.0 | 0.55 | 25 | 7 | — | uniform structure, tabular grain |
| Emulsion D | 9.0 | 0.65 | 25 | 6 | [12/59/29] (0/11/8) | triple structure, tabular grain |
| Emulsion E | 9.0 | 0.85 | 23 | 5 | [8/59/33] (0/11/8) | triple structure, tabular grain |
| Emulsion F | 14.5 | 1.25 | 25 | 3 | [37/63] (34/3) | double structure, plate-like grain |
| Emulsion G | 1.0 | 0.07 | 15 | 1 | — | uniform structure, fine grain |

In Table 1, (1) Emulsions A to F were subjected to reduction sensitization using thiourea dioxide and thiosulfonic acid during the grain preparation according to the example of JP-A-2-191938.

(2) Emulsions A to F were subjected to gold sensitization, sulfur sensitization and selenium sensitization in the presence of the spectral sensitizing dye used in each light-sensitive layer and sodium thiocyanate according to the example of JP-A-3-237450.

(3) In the preparation of tabular grains, low molecular weight gelatin was used according to the example of JP-A-1-158426.

(4) In tabular grains and regular crystal grains having a grain structure, a dislocation line was observed by means of a high-pressure electron microscope ExC-1
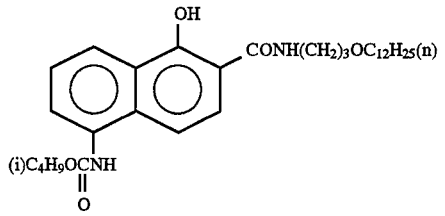
ExC-2
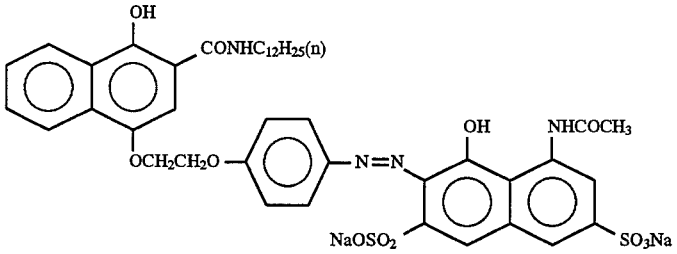
ExC-3
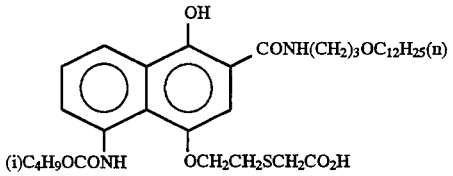
ExC-4
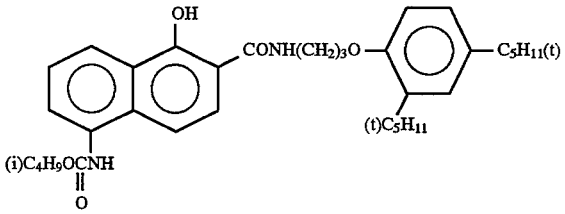
ExC-5
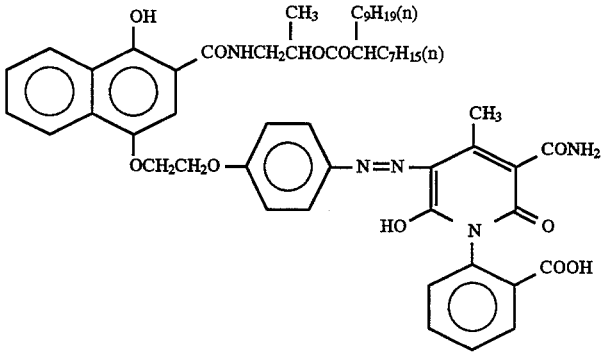
ExC-6
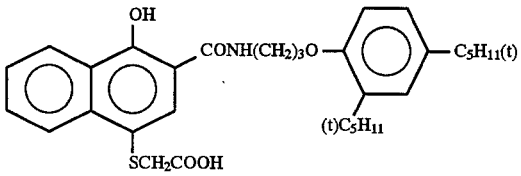

-continued
ExC-7
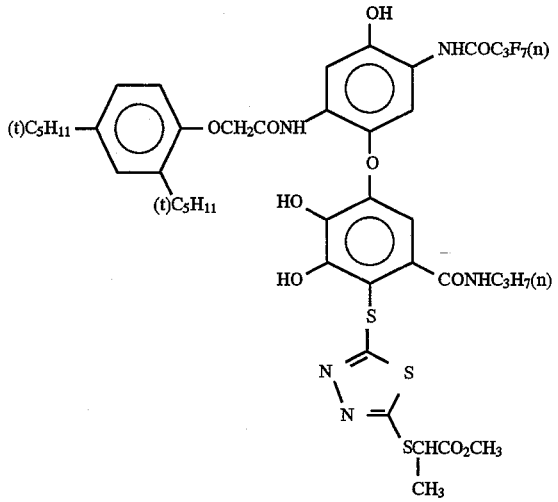
ExC-8
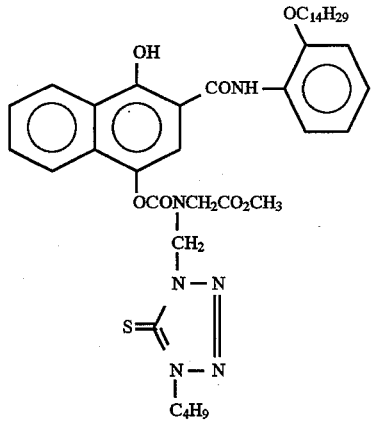
ExM-1
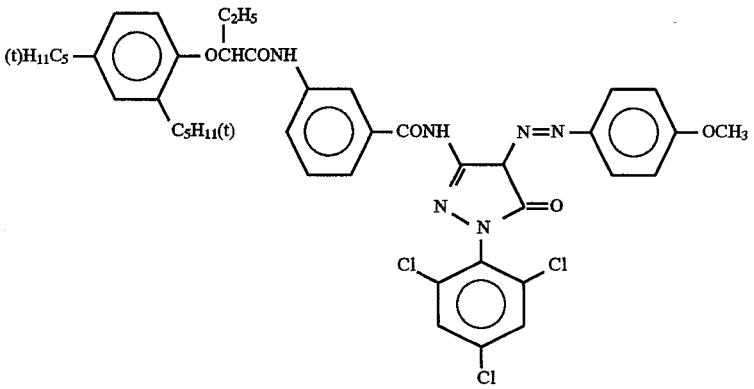
ExM-2
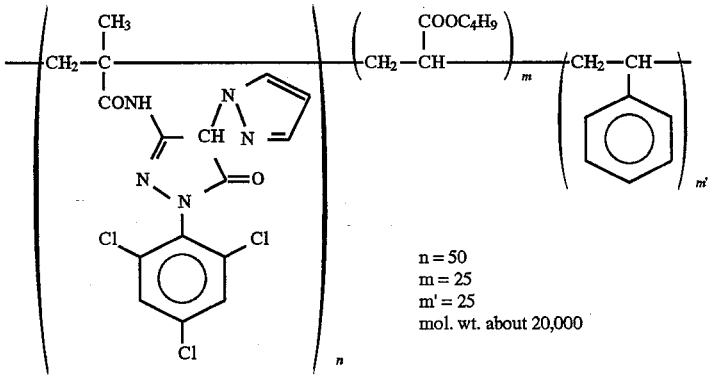

-continued
ExM-3
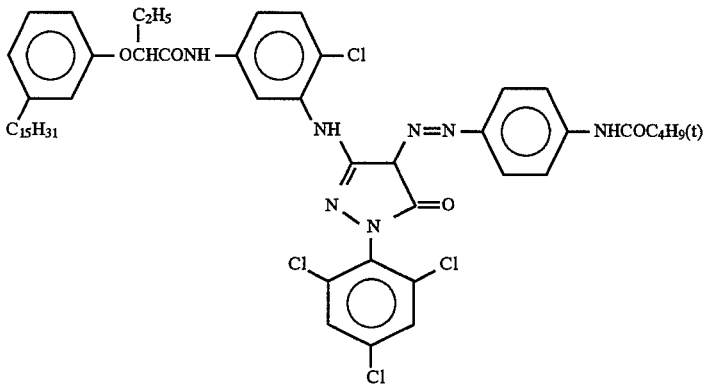
ExM-4
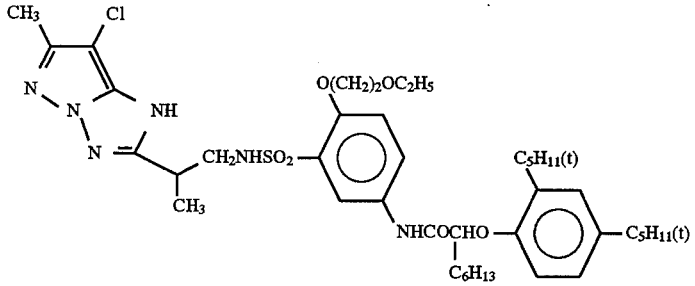
ExM-5
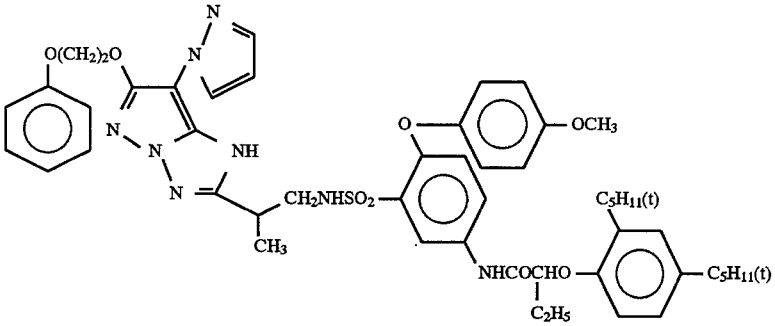
ExY-1
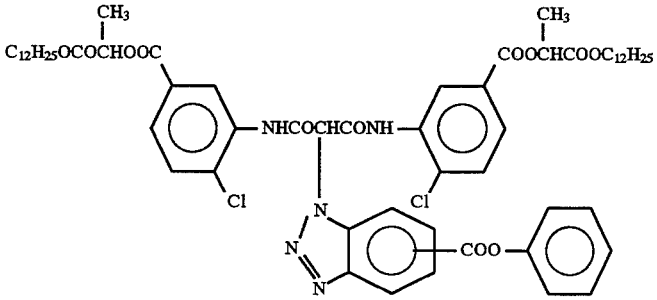
ExY-2
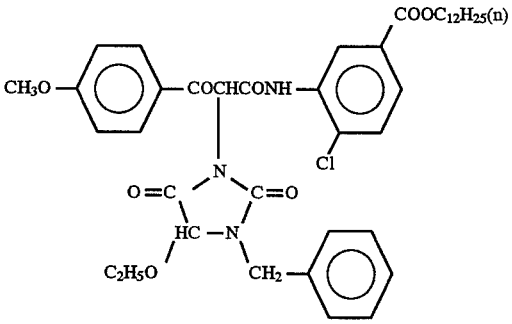
ExY-3
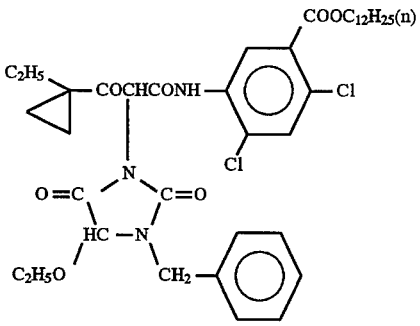

-continued
ExY-4
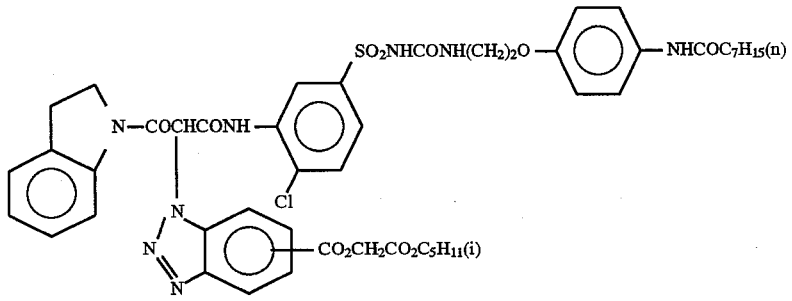
ExF-1
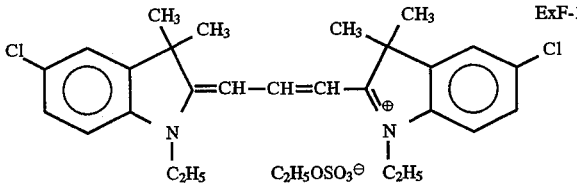
Cpd-1
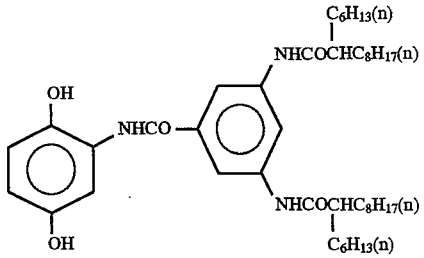
Cpd-2
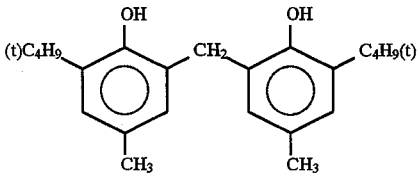
Cpd-3
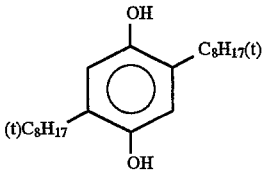
UV-1
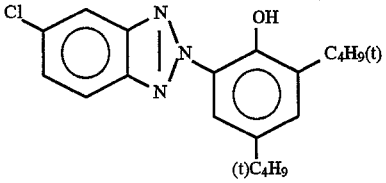
UV-2
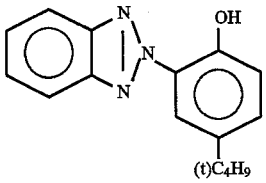
UV-3
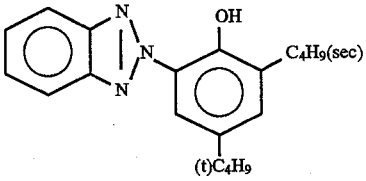
UV-4
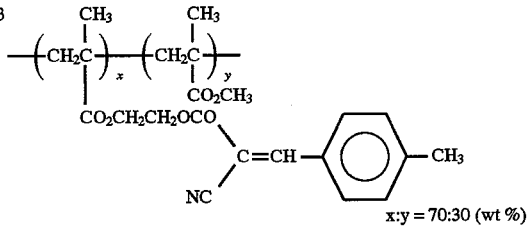
UV-5
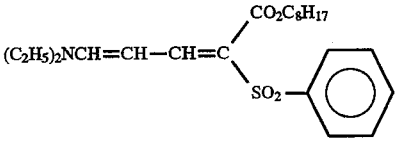
Tricresyl phosphate
HBS-1
Di-n-butyl phthalate
HBS-2
HBS-3
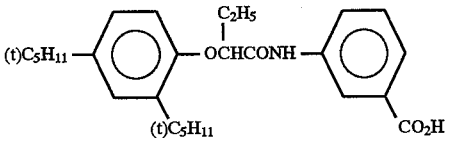
ExS-1
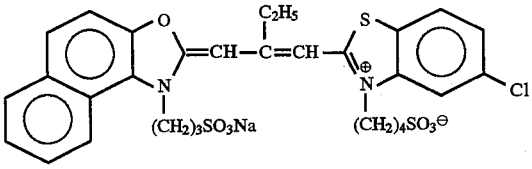
ExS-2
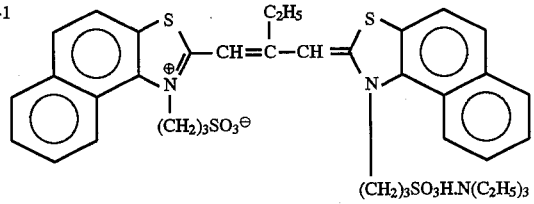

-continued
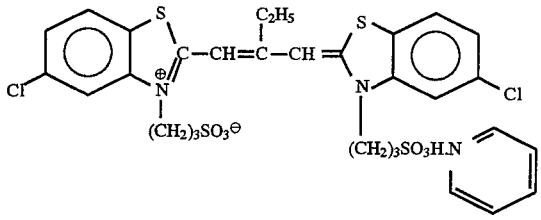
ExS-3
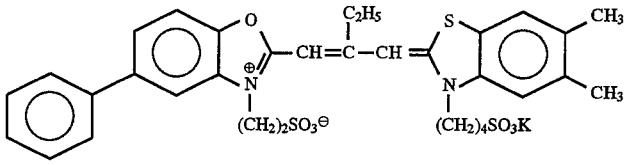
ExS-4
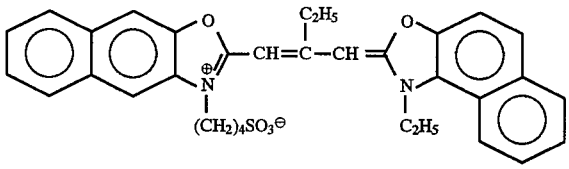
ExS-5
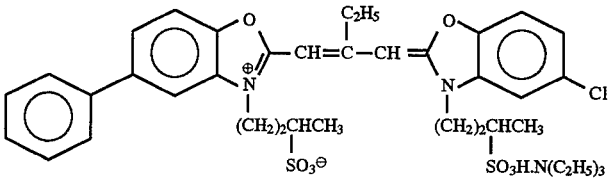
ExS-6
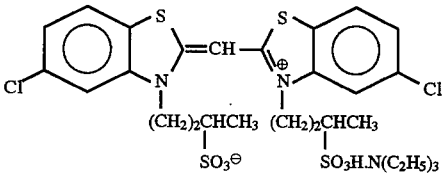
ExS-7
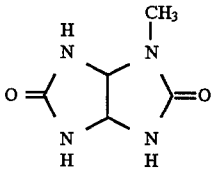
S-1
$CH_2{=}CH{-}SO_2{-}CH_2{-}CONH{-}CH_2$
$CH_2{=}CH{-}SO_2{-}CH_2{-}CONH{-}CH_2$
H-1
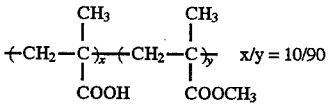
x/y = 10/90
B-1
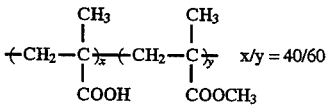
x/y = 40/60
B-2
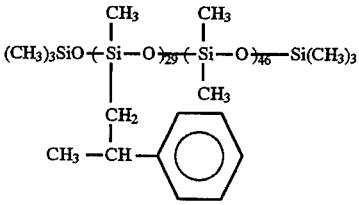
B-3
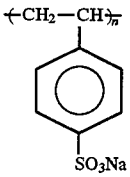
B-4
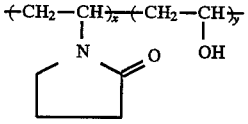
x/y = 70/30
B-5
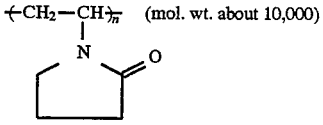
(mol. wt. about 10,000)
B-6
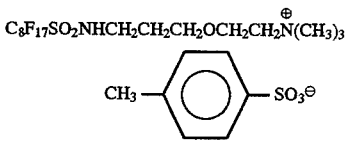
W-1

-continued
W-2
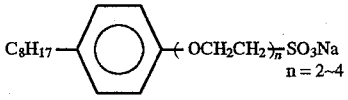
W-3
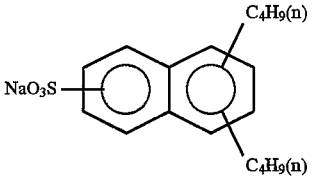
F-1
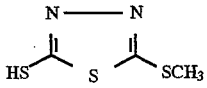
F-2
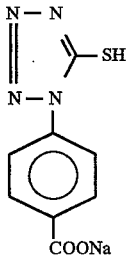
F-3
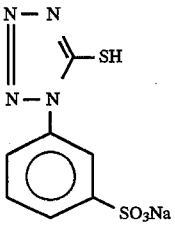
F-4
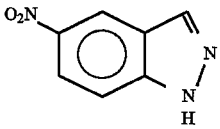
F-5
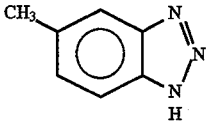
F-6
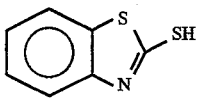
F-7
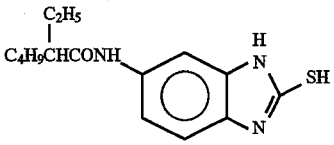
F-8
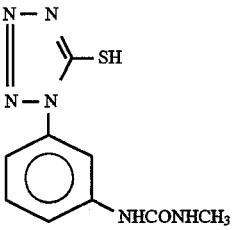
F-9
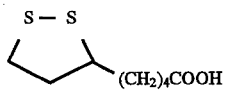
F-10
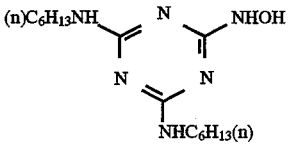
F-11
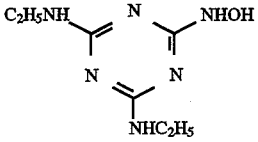
F-12
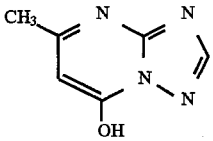
F-13
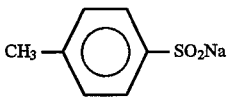
F-14
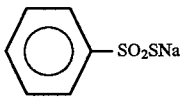
F-15
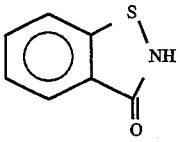
F-16
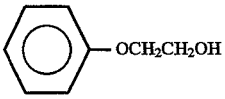

-continued

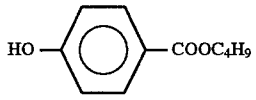

F-17

The thus-prepared multilayer color photographic material Sample 101 was exposed and then processed in an automatic processor through the following steps (until the cumulative replenishing amount, reached 3 times the tank volume).

(Processing Method)

| Step | Processing Time | Processing Temperature (°C.) | Replenishing Amount (ml) | Tank Volume (l) |
|---|---|---|---|---|
| Color Development | 3 min. 10 sec. | 38 | 20 | 20 |
| Bleaching | 3 min. 00 sec. | 38 | 25 | 40 |
| Washing (1) | 15 sec. | 24 | Counter-current piping system from (2) to (1) | 10 |
| Washing (2) | 15 sec. | 24 | 15 | 10 |
| Fixing | 3 min. 00 sec. | 38 | 15 | 30 |
| Washing (3) | 30 sec. | 24 | Counter-current piping system from (4) to (3) | 10 |
| Washing (4) | 30 sec. | 24 | 1,200 | 10 |
| Stabilization | 30 sec. | 38 | 20 | 10 |
| Drying | 4 min. 20 sec. | 55 | | |

The replenishing amount was per 1-m length in 35-mm width.

The compositions of the processing solutions are shown below.

| (Color Developer) | Tank Solution (g) | Replenisher (g) |
|---|---|---|
| Diethylenetriaminepenta-acetic acid | 1.0 | 1.3 |
| 1-Hydroxyethylidene-1,1-diphosphonic acid | 2.0 | 2.3 |
| Sodium sulfite | 4.0 | 4.9 |
| Potassium carbonate | 30.0 | 39.3 |
| Potassium bromide | 1.4 | 0.25 |
| Potassium iodide | 1.5 mg | — |
| Hydroxylamine sulfate | 2.4 | 3.2 |
| 4-[N-Ethyl-N-(β-hydroxy-ethyl)amino]-2-methylaniline sulfate | 4.5 | 6.2 |
| Water to make | 1.0 l | 1.0 l |
| pH (adjusted by potassium hydroxide and sulfuric acid) | 10.05 | 10.15 |

| (Bleaching Solution) | Tank Solution | Replenisher |
|---|---|---|
| Chelating compound (disclosed in Tables 2 to 4) | 0.18 mol | 0.22 mol |
| Ferric nitrate nonahydrate | 0.16 mol | 0.20 mol |
| Organic acid (disclosed in Tables 2 to 4) | disclosed in Tables 2 to 4 | 1.2-fold mol of tank solution |
| 3-Mercapto-1,2,4-triazole | 0.03 g | 0.08 g |
| Ammonium bromide | 140.0 g | 160.0 g |
| Ammonium nitrate | 30.0 g | 35.0 g |
| Aqueous ammonia (27%) | 6.5 ml | 4.0 ml |
| Water to make | 1.0 l | 1.0 g |
| pH (adjusted with aqueous ammonia and nitric acid) | 6.0 | 5.7 |

-continued

| (Fixing Solution) | Tank Solution (g) | Replenisher (g) |
|---|---|---|
| Organic acid (described in in Tables 2 to 4) | described in Tables 2 to 4 | 1.4-fold mol of tank solution |
| Ammonium sulfite | 20.0 | 22.0 |
| Aqueous solution of ammonium thiosulfate (700 g/l) | 295.0 ml | 320.0 ml |
| Acetic acid (90%) | 3.3 | 4.0 |
| Water to make | 1.0 l | 1.0 l |
| pH (adjusted with aqueous ammonia and acetic acid) | 6.7 | 6.8 |

| (Stabilizing Solution) | Tank Solution/ Replenisher in common (g) |
|---|---|
| Sodium p-toluenesulfinate | 0.03 |
| Polyoxyethylene-p-monononylphenylether (average polymerization degree: 10) | 0.2 |
| Disodium ethylenediaminetetraacetate | 0.05 |
| 1,2,4-Triazole | 1.3 |
| 1,4-Bis(1,2,4-triazole-1-ylmethyl)piperazine | 0.75 |
| Water to make | 1.0 l |
| pH | 8.5 |

The thus-processed multilayer color photographic material Sample 101 was subjected to the determination of residual silver amount at the maximum color density area according to the fluorescent X-ray analysis. The results obtained are shown in Tables 2 to 4.

Also, the thus-processed Photographic Sample 101 was subjected to the measurement of the Dmin value with green light (G light).

Then, the above-described multilayer color photographic material Sample 101 was stored under the following conditions and the increase in stains during storage of the processed photographic material was determined from the change in density between before and after the storage with respect to Dmin at the non-colored area.

Dark and humidity/temperature conditions: 60° C., 70% RH

Increase in stains (AD) after 4 weeks=(Dmin after the storage)−(Dmin before the storage)

The results are also shown in Tables 2 to 4.

TABLE 2

| No. | Chelating Compound | Organic Acid in Bleaching Solution (addition amount, mol) | Organic Acid in Fixing Solution (addition amount, mol) | Residual Silver amount (μg/cm²) | Increase in Stain ΔD(G) | Remarks |
|---|---|---|---|---|---|---|
| 101 | Comparative Compound A | — | — | 21.0 | 0.08 | Comparison |
| 102 | Comparative Compound A | — | disodium ethylenediaminetetraacetate ($1.5 \times 10^{-3}$) | 20.0 | 0.07 | " |
| 103 | Comparative Compound A | III-1 (0.03) | — | 10.5 | 0.17 | " |
| 104 | Comparative Compound A | " | disodium ethylenediaminetetraacetate ($1.5 \times 10^{-3}$) | 10.4 | 0.10 | " |
| 105 | Comparative Compound A | " | β-alanine diacetic acid ($1.5 \times 10^{-2}$) | 9.4 | 0.12 | " |
| 106 | Comparative Compound B | — | — | 32.0 | 0.04 | " |
| 107 | Comparative Compound B | III-1 (0.03) | — | 27.0 | 0.10 | " |
| 108 | Comparative Compound B | " | ethylenediamine-N,N'-disuccinic acid ($1.5 \times 10^{-3}$) | 26.5 | 0.08 | " |
| 109 | Comparative Compound C | — | — | 5.7 | 0.07 | " |
| 110 | Comparative Compound C | III-1 (0.03) | — | 5.4 | 0.12 | " |
| 111 | Comparative Compound C | " | 1,3-propanediamine-N,N'-disuccinic acid ($1.5 \times 10^{-3}$) | 5.3 | 0.10 | " |
| 112 | I-1 | — | — | 6.9 | 0.04 | " |
| 113 | " | acetic acid (0.03) | — | 7.0 | 0.04 | " |
| 114 | " | acetic acid (0.10) | — | 8.2 | 0.04 | " |
| 115 | " | malonic acid (0.03) | — | 6.5 | 0.04 | " |
| 116 | " | malonic acid (0.10) | — | 8.0 | 0.04 | " |
| 117 | " | citric acid (0.03) | — | 7.4 | 0.04 | " |
| 118 | " | citric acid (0.10) | — | 9.5 | 0.04 | " |

TABLE 3

| No. | Chelating Compound | Organic Acid in Bleaching Solution (addition amount, mol) | Organic Acid in Fixing Solution (addition amount, mol) | Residual Silver amount (μg/cm²) | Increase in Stain ΔD(G) | Remarks |
|---|---|---|---|---|---|---|
| 119 | Comparative Compound A | fumaric acid (0.03) | — | 7.6 | 0.04 | Comparison |
| 120 | Comparative Compound A | fumaric acid (0.10) | — | 9.7 | 0.05 | " |
| 121 | Comparative Compound A | acetic acid (0.03) | 1,3-propanediaminetetraacetic acid ($1.5 \times 10^{-3}$) | 6.5 | 0.04 | " |
| 122 | II-1 | — | — | 6.7 | 0.04 | " |
| 123 | " | acetic acid (0.03) | — | 6.9 | 0.04 | " |
| 124 | " | malonic acid (0.03) | — | 6.6 | 0.04 | " |
| 125 | " | citric acid (0.03) | — | 7.7 | 0.04 | " |
| 126 | " | fumaric acid (0.03) | — | 8.0 | 0.05 | " |
| 127 | " | fumaric acid (0.03) | β-alaninediacetic acid ($1.5 \times 10^{-2}$) | 6.8 | 0.04 | " |
| 128 | I-1 | III-1 (0.03) | — | 2.0 | 0.05 | Invention |
| 129 | " | III-1 (0.10) | — | 1.9 | 0.05 | " |
| 130 | I-1 | III-1 (0.03) | disodium ethylenediaminetetraacetate ($1.5 \times 10^{-3}$) | 1.9 | 0.02 | " |
| 131 | " | III-1 (0.03) | ethylenediamine-N,N'-disuccinic acid ($1.5 \times 10^{-3}$) | 1.8 | 0.03 | " |
| 132 | " | III-1 (0.03) | 1,3-propanediaminetetraacetic acid ($1.5 \times 10^{-3}$) | 1.5 | 0.03 | " |
| 133 | " | III-1 (0.03) | 1,3-propanediamine-N,N'-disuccinic acid ($1.5 \times 10^{-3}$) | 1.6 | 0.03 | " |
| 134 | " | III-1 (0.03) malonic acid (0.03) | β-alaninediacetic acid ($1.5 \times 10^{-2}$) | 1.7 | 0.03 | " |
| 135 | " | III-12 (0.03) | disodium ethylenediaminetetraacetate ($1.5 \times 10^{-3}$) | 2.2 | 0.05 | " |
| 136 | " | III-12 (0.10) | disodium ethylenediaminetetraacetate ($1.5 \times 10^{-3}$) | 2.0 | 0.05 | " |
| 137 | II-1 | III-1 (0.03) | disodium ethylenediaminetetraacetate ($1.5 \times 10^{-3}$) | 1.8 | 0.03 | |
| 138 | " | III-1 (0.10) | disodium ethylenediaminetetraacetate ($1.5 \times 10^{-3}$) | 1.7 | 0.04 | |

TABLE 4

| No. | Chelating Compound | Organic Acid in Bleaching Solution (addition amount, mol) | Organic Acid in Fixing Solution (addition amount, mol) | Residual Silver amount ($\mu g/cm^2$) | Increase in Stain ΔD(G) | Remarks |
|---|---|---|---|---|---|---|
| 139 | II-1 | III-1 (0.15) | disodium ethylenediaminetetraacetate ($1.5 \times 10^{-3}$) | 1.8 | 0.04 | Invention |
| 140 | II-9 | III-11 (0.03) | disodium ethylenediaminetetraacetate ($1.5 \times 10^{-3}$) | 1.7 | 0.04 | " |
| 141 | II-10 | III-15 (0.03) | disodium ethylenediaminetetraacetate ($1.5 \times 10^{-3}$) | 1.8 | 0.05 | " |
| 142 | II-11 | III-4 (0.03) | disodium ethylenediaminetetraacetate ($1.5 \times 10^{-3}$) | 1.9 | 0.05 | " |
| 143 | II-15 | III-5 (0.03) | disodium ethylenediaminetetraacetate ($1.5 \times 10^{-3}$) | 1.8 | 0.04 | " |
| 144 | II-17 | III-6 (0.03) | disodium ethylenediaminetetraacetate ($1.5 \times 10^{-3}$) | 2.0 | 0.04 | " |
| 145 | II-20 | III-1 (0.03) | disodium ethylenediaminetetraacetate ($1.5 \times 10^{-3}$) | 1.8 | 0.05 | " |
| 146 | " | " | ethylenediaminetetramethylene phosphonic acid ($1.5 \times 10^{-3}$) | 1.8 | 0.03 | |

Comparative Compound A

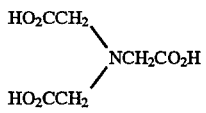

Comparative Compound B

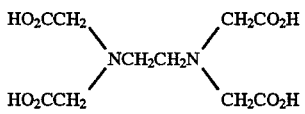

Comparative Compound C

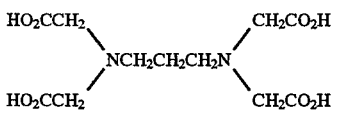

As seen from the results in Tables 2 to 4, with the combination of Comparative Compound B or C and the compound represented by formula (III), almost no improvement in the desilvering property was provided. In the case of the combination of Comparative Compound A and the compound represented by formula (III), although the desilvering property was improved, the desilvering degree stayed at an insufficient level and stains increased. On the other hand, according to the present invention, good results were obtained with respect to both the desilvering property and stain. Further, the desilvering property was reduced by the addition of a large amount of an organic acid such as acetic acid, malonic acid, citric acid and fumaric acid, but the desilvering property remained good with the addition, even in a large amount, of the compound represented by formula (III) of the present invention. Furthermore, in the case where the compound of the present invention was used, it is seen that the stain was much more improved by adding an aminopolycarboxylic acid or an organic phosphonic acid to the fixing solution.

EXAMPLE 2

Sample 103 described in JP-A-4-145433 (corresponding to U.S. Pat. No. 5,264,332) was processed as follows:

| [Processing Step] | [Temperature] (°C.) | [Time] (sec.) |
|---|---|---|
| Color Development | 38 | 45 |
| Bleach-Fixing | 35 | 25 |
| Rinsing (1) | 35 | 20 |
| Rinsing (2) | 35 | 20 |
| Rinsing (3) | 35 | 20 |
| Drying | 80 | 60 |
| (Color Developer) | | |
| Water | | 600 ml |
| Ethylenediamine-N,N,N',N'-tetra-methylene phosphonic acid | | 2.0 g |
| Potassium bromide | | 0.015 g |
| Potassium chloride | | 3.1 g |
| Triethanolamine | | 10.0 g |
| Potassium carbonate | | 27 g |
| Fluorescent brightener (WHITEX · 4B, produced by Sumitomo Chemical Co., Ltd.) | | 1.0 g |
| Diethylhydroxylamine | | 4.2 g |
| N-Ethyl-N-(β-methanesulfonamidoethyl)-3-methyl-4-aminoaniline sulfate | | 5.0 g |
| Water to make | | 1,000 ml |
| pH (at 25° C.) | | 10.05 |
| (Bleach-fixing Solution) | | |
| Water | | 400 ml |
| Ammonium thiosulfate (700 g/l) | | 100 ml |
| Sodium sulfite | | 17 g |
| Iron chloride | | 0.30 mol |
| Chelating compound (described in Table 5) | | 0.33 mol |
| Compound of formula (III) (described in Table 5) | | 0.03 mol |
| Ammonium bromide | | 40 g |
| Water to make | | 1,000 ml |
| pH (at 25° C.) | | 6.8 |
| (Rinsing Solution) | | |
| Ion-exchanged water (the calcium and magnesium contents each was 3 ppm or less) | | |

The samples was uniformly exposed so as to provide a gray density of 1.5, processed in the same manner as above and then subjected to the quantitation of residual silver amount at the maximum density area by the fluorescent X-ray method. The results are shown in Table 5.

TABLE 5

| No. | Chelating Compound | Compound of Formula (III) | Residual Silver Amount ($\mu g/cm^2$) | Remarks |
|---|---|---|---|---|
| 201 | Comparative Compound B | — | 23.0 | Comparison |

TABLE 5-continued

| No. | Chelating Compound | Compound of Formula (III) | Residual Silver Amount (μg/cm²) | Remarks |
|---|---|---|---|---|
| 202 | Comparative Compound B | III-1 | 20.3 | " |
| 203 | I-1 | III-1 | 2.4 | Invention |
| 204 | I-3 | " | 2.3 | " |
| 205 | I-11 | " | 2.3 | " |
| 206 | II-1 | III-4 | 2.0 | " |
| 207 | II-9 | III-1 | 1.8 | " |
| 208 | II-10 | " | 1.9 | " |
| 209 | II-11 | " | 2.2 | " |
| 210 | II-15 | " | 1.9 | " |
| 211 | II-17 | III-16 | 2.2 | " |
| 212 | II-20 | III-6 | 2.1 | " |

Comparative Compound B is the same as in Example 1.

From the results above, it is seen that the residual silver amount was reduced according to the present invention as compared with that in comparative examples.

EXAMPLE 3

Compounds I-1, II-1, II-2, II-5, II-9, II-10, II-15, II-17, II-20, III-1, III-4 and III-15 of the present invention were subjected to the biodegradation test in accordance with "OECD Chemical Test Guide Line" 302B Revised Zahn-Wellens Method and they each showed a good biodegradability (70% or more degradation for 28 days). From this result, the compounds used in the present invention was verified to be advantageous from the standpoint of global environmental protection.

The compounds of the present invention used in the practice of the present invention have biodegradability and hence, contribute to the environmental conservation, and the processing composition of the present invention using the above-described compounds is little susceptible to the occurrence of stains after processing and enables a rapid processing accompanied by an excellent desilvering property.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising processing an imagewise exposed silver halide color photographic material with a processing solution having bleaching ability after color development, wherein said processing solution having bleaching ability comprises at least one ferric complex salt of the compound represented by formula (I) or (II) and at least one compound represented by formula (III), said at least one ferric complex salt of the compound represented by formula (I) or (II) is present in said processing solution having bleaching ability in an amount of from 0.005 to 1 mol per liter of said processing solution having bleaching ability, and said at least one compound represented by formula (III) is present in said processing solution having bleaching ability in an amount of from 0.001 to 0.3 mol per liter of said processing solution having bleaching ability:

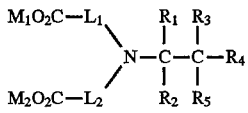

(I)

wherein $R_1$, $R_2$, $R_3$, $R_4$ and $R_5$ each represents a hydrogen atom, an aliphatic group, an aryl group, a heterocyclic group, a carboxyl group, a phosphono group, a hydroxy group or a sulfo group, with the proviso that at least one of $R_1$, $R_2$, $R_3$, $R_4$ and $R_5$ represents a carboxyl group, a phosphono group, a sulfo group, or an aliphatic, aryl or heterocyclic group substituted by a carboxyl group; $L_1$ and $L_2$ each represents a divalent aliphatic group, a divalent aromatic group or a divalent linking group composed of a combination thereof; and $M_1$ and $M_2$ each represents a hydrogen atom or a cation;

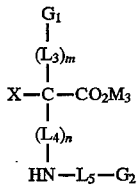

(II)

wherein $G_1$ and $G_2$ each represents a carboxyl group, a phosphono group, a hydroxyl group, a sulfo group, a mercapto to group, an aryl group, a heterocyclic group, an alkylthio group, an amidino group, a guanidino group or a carbamoyl group; $L_3$, $L_4$ and $L_5$ each represents a divalent aliphatic group, a divalent aromatic group or a divalent linking group composed of a combination thereof; m and n each represents 0 or 1; X represents a hydrogen atom, an aliphatic group, an aryl group or a heterocyclic group; and $M_3$ represents a hydrogen atom or a cation;

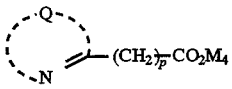

(III)

wherein Q represents a pyridine group, a pyrazine group, a pyrimidine group, a pyridazine group, a pyrrole group, an imidazole group, a pyrazole group, a thiazole group, an oxazole group, a triazole group, a thiadiazole group, a triazine group or an indole group.

2. The method for processing a silver halide color photographic material as claimed in claim 1, which further comprises processing with a processing solution having fixing ability which contains an aminopolycarboxylic acid and/or an organic phosphonic acid after processing with said processing solution having bleaching ability.

3. The method for processing a silver halide color photographic material as claimed in claim 1, wherein the compound represented by formula (I) is a compound represented by formula (IV)

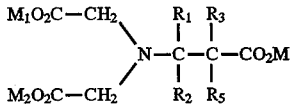

(IV)

wherein $M_1$ and $M_2$ each has the same meaning as those in formula (I), $R_1$, $R_2$, $R_3$ and $R_5$ each represents a hydrogen atom, an aliphatic group an aryl group, a heterocyclic group, a carboxyl group, a phosphono group, a hydroxyl group or a sulfo group, and M has the same meaning as $M_1$ in formula (I).

4. The method for processing a silver halide color photographic material as claimed in claim 1, wherein the compound represented by formula (II) is a compound represented by formula (V)

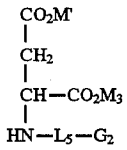

(V)

wherein $G_2$, $L_5$ and $M_3$ each has the same meaning as those in formula (II), and M' represents a hydrogen atom or a cation.

5. The method for processing a silver halide color photographic material as claimed in claim 1, wherein p is 0 in formula (III).

6. The method for processing a silver halide color photographic material as claimed in claim 1, wherein the nitrogen-containing heterocyclic ring formed by Q is a 5- or 6-membered nitrogen-containing aromatic heterocyclic ring.

7. The method for processing a silver halide color photographic material as claimed in claim 1, wherein the nitrogen-containing heterocyclic ring formed by Q is pyridine.

8. The method for processing a silver halide color photographic material as claimed in claim 2, wherein the aminopolycarboxylic acid or the organic phosphonic acid represents ethylenediamine-N,N'-disuccinic acid, 1,3-propylenediamine-N,N'-disuccinic acid, 1-hydroxyethylidene-1,1-diphosphonic acid, nitrilotrimethylene phosphonic acid, 2-hydroxy-1,3-diaminopropanetetraacetic acid, ethylenediaminetetraacetic acid, diethylenetriaminepentaacetic acid, ethylenediamine-N-(β-hydroxyethyl)-N,N',N'-triacetic acid, 1,2-diaminopropanetetraacetic acid, 1,3-diaminopropanetetraacetic acid, nitrilotriacetic acid, cyclohexanediaminetetraacetic acid, iminodiacetic acid, N-(2-carboxyphenyl)iminodiacetic acid, dihydroxyethlglycine, ethyletherdiaminetetraacetic acid, glycol ether diaminetetraacetic acid, ethylenediaminetetrapropionic acid, glycinediproponic acid, phenylenediaminetetraacetic acid, 1,3-diaminopropanol-N,N,N',N'-tetramethylene phosphonic acid, ethylenediamine-N,N,N',N'-tetramethylene phosphonic acid, 1,3-propanediamine-N,N,N',N'-tetramethylene phosphonic acid, serine-N,N-diacetic acid, 2-methylserine-N,N-diacetic acid, 2-hydroxymethylserine-N,N-diacetic acid, hydroxyethyliminodiacetic acid, methyliminodiacetic acid, N-(2-acetamido)-iminodiacetic acid, nitrilotripropionic acid, ethylenediaminediacetic acid, ethylenediaminedipropionic acid, 1,4-diaminobutanetetraacetic acid, 2-methyl-1,3-diaminopropanetetraacetic acid, 2,2-dimethyl-1,3-diaminopropanetetraacetic acid, β-alaninediacetic acid, alanine, tartaric acid, hydrazinediacetic acid, N-hydroxyiminodipropionic acid, or an alkali metal salt or an ammonium salt thereof.

9. The method for processing a silver halide color photographic material as claimed in claim 2, wherein the aminopolycarboxylic acid or the organic phosphonic acid is used in an amount of from 0.0001 to 0.5 mol per liter of said processing solution having fixing ability.

* * * * *